US011103074B2

(12) United States Patent
Kim

(10) Patent No.: US 11,103,074 B2
(45) Date of Patent: Aug. 31, 2021

(54) MULTI-POSITIONAL CHAIR ASSEMBLY

(71) Applicant: Insu Kim, New York, NY (US)

(72) Inventor: Insu Kim, New York, NY (US)

( * ) Notice: Subject to any disclaimer, the term of this patent is extended or adjusted under 35 U.S.C. 154(b) by 0 days.

(21) Appl. No.: 16/922,768

(22) Filed: Jul. 7, 2020

(65) Prior Publication Data

US 2021/0112989 A1 Apr. 22, 2021

Related U.S. Application Data

(63) Continuation-in-part of application No. 16/658,882, filed on Oct. 21, 2019, now Pat. No. 10,722,038.

(51) Int. Cl.

| | |
|---|---|
| ***A47C 7/16*** | (2006.01) |
| ***A47C 13/00*** | (2006.01) |
| ***A47C 15/00*** | (2006.01) |
| ***A47C 3/04*** | (2006.01) |
| ***A47C 5/12*** | (2006.01) |
| ***A47C 1/14*** | (2006.01) |
| ***A47C 5/04*** | (2006.01) |
| ***A47C 7/22*** | (2006.01) |

(52) U.S. Cl.

CPC ..... *A47C 13/00* (2013.01); *A47C 1/143* (2013.01); *A47C 3/04* (2013.01); *A47C 5/04* (2013.01); *A47C 5/12* (2013.01); *A47C 7/16* (2013.01); *A47C 7/22* (2013.01)

(58) Field of Classification Search

CPC ..... A47C 13/00; A47C 12/02; A47C 15/00; A47C 7/282; A47C 7/16; A47C 7/285

See application file for complete search history.

(56) References Cited

U.S. PATENT DOCUMENTS

| | | | | |
|---|---|---|---|---|
| 2,425,884 A | | 8/1947 | Janssen | |
| 2,749,971 A | * | 6/1956 | Ehrman | A47C 13/00 297/119 |
| 3,473,843 A | | 10/1969 | Reginald | |
| 3,695,702 A | * | 10/1972 | Ingellis | A47C 4/02 297/440.24 |

(Continued)

FOREIGN PATENT DOCUMENTS

| | | | | |
|---|---|---|---|---|
| DE | 2213490 A1 | * | 10/1972 | A47C 7/285 |
| DE | 3430063 A1 | * | 2/1986 | A47C 12/02 |

(Continued)

*Primary Examiner* — Timothy J Brindley

(74) *Attorney, Agent, or Firm* — Vincent G. LoTempio

(57) ABSTRACT

A multi-positional chair assembly comprises a frame portion defined by a pair of sinuously-shaped bars. The frame portion includes a back support section, a middle section, and a buttocks support section. A panel provides a supportive surface for a user. The panel may include a metal sheet, apertures, or parallel strips of material. The frame portion can be positioned in multiple positions to provide a sitting surface, including a lounge chair position and a higher elevated stool position. The chair assembly reconfigures between the lounge chair position and the stool position through rotation. Rotating the buttocks support section and the legs to engage the ground surface achieves the lounge chair position. And rotating the back support section and the legs to engage the ground surface achieves the stool position. The chair may be of a one-piece injection-molded construction.

20 Claims, 16 Drawing Sheets

(56) References Cited

U.S. PATENT DOCUMENTS

| | | | | | |
|---|---|---|---|---|---|
| 3,744,845 | A * | 7/1973 | Sooker | A47B 13/02 | 297/423.44 |
| 3,836,194 | A | 9/1974 | Milette | | |
| 5,669,658 | A * | 9/1997 | Liles | A47B 85/04 | 297/123 |
| 5,722,716 | A * | 3/1998 | Thomas | A47C 13/00 | 297/118 |
| 9,271,576 | B2 | 3/2016 | Loney | | |
| 2004/0222676 | A1* | 11/2004 | Okabayashi | A47C 7/024 | 297/29 |
| 2017/0164746 | A1* | 6/2017 | Phillips | A47C 7/185 | |
| 2018/0263372 | A1 | 9/2018 | Rohrer | | |
| 2019/0313776 | A1* | 10/2019 | Ripepi | A01M 31/02 | |

FOREIGN PATENT DOCUMENTS

| | | | | | |
|---|---|---|---|---|---|
| DE | 3637903 | A1 * | 5/1988 | A47C 9/005 | |
| DE | 9312719 | U1 * | 12/1994 | A47C 3/029 | |
| DE | 19610843 | A1 * | 9/1997 | A47C 7/44 | |
| FR | 2106787 | A5 * | 5/1972 | A47B 83/00 | |
| JP | 2001129120 | A * | 5/2001 | A47C 13/00 | |
| JP | WO-2012056854 | A1 * | 5/2012 | | |

* cited by examiner

MULTI-POSITIONAL CHAIR ASSEMBLY

CROSS-REFERENCE TO RELATED APPLICATIONS

This application is a continuation-in-part of U.S. patent application Ser. No. 16/658,882 filed Oct. 21, 2019, which is incorporated by reference herein.

FIELD

The present invention relates generally to a multi-positional chair assembly. More so, the present invention relates to a chair assembly comprises a frame portion defined by a pair of sinuous shape traversed by a flexible panel, which can be positioned in multiple positions to provide a sitting surface, from either a lounge chair position, and a higher elevated stool position.

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, chair designs for office, home, waiting rooms, and the like, are designed for optimum posture of the chair occupant. Typically, the back portion of these chairs is designed to match the curves of the human trunk. Also, a bar stool is a type of tall chair, often with a foot rest to support the feet. The height and narrowness of bar stools makes them suitable for use at bars and high table.

It is known in the art that small living spaces and an on-going interest in multi-purposeful and flexible spaces in today's modern society can be explained with a continual growing population. Human factors and ergonomics haven't changed, but the growing urban housing development requires new design to adapt its urban phenomenon. Given the fact that living spaces are being smaller, the solution is on re-configuring furniture while maintaining the primary human needs and comfort.

There has been a fixed idea of what a chair can be, typically a stationary chair with one function. In addition, placing the chairs with high and low seating heights in front of each other where the chair in the back functions as a stool while the chair in front reclines as a lounging position provide unobstructed views during events. Its convertible feature minimizes seating needs by enabling users to customize seating preferences.

The present invention of a multi-positional chair assembly provides a dual-purpose chair that can be converted either as a lounge chair or a bar stool. Both positions are ergonomically dimensioned with ideal heights, widths and angles that not only offers comfort but its capacity to transport, with stackable features for optimal storage use.

Plastic chairs are well-known. An exemplary prior art plastic chair is shown in U.S. Pat. No. Des. 373,255. This prior art chair includes a seat, a back, front and rear legs directly connected to the seat, and arms joining the seat to the back. These chairs include an opening bounded by the arms, back and seat. Plastic chairs with this configuration can be stacked vertically, so that the rear legs of the uppermost chair extend through the opening bounded by the arms, back and seat. The chairs are configured so that they vertically stack compactly. Consequently, the chairs can be shipped, stored, and displayed more economically. This is advantageous for manufacturers, retailers, and consumers. Plastic chairs are also advantageous because they are comfortable, inexpensive to manufacture, practical, lightweight, portable, water and weatherproof, sturdy, attractive, relatively easy to care for, and easy to move to and from a stacked arrangement.

Molded plastic chairs are well known in the art. Molded chairs may be comprised of thermoplastics, polymers or cast from metal. Two known injection-molded, stacking rocking chairs comprise the Adams Manufacturing Corporation's Big Easy® and Lil' Easy® rocking chairs. The two chairs are essentially the same, except the Big Easy® is an adult-sized chair and the UT Easy® is a child-sized chair. Both chairs are manufactured by Adams under license of Cooper C. Woodring's U.S. Pat. No. 8,070,229 issued Dec. 6, 2011, U.S. Pat. No. 8,313,141 issued Nov. 20, 2012, U.S. Pat. No. 8,960,792 issued Feb. 24, 2015 and U.S. Pat. No. 9,510,681 issued Dec. 6, 2016, all of which are specifically incorporated herein by reference. U.S. Pat. No. 8,191,963 issued Jun. 5, 2012 to Gamboa discloses a one-piece, injection-molded thermoplastic construction for a chair which is weatherproof and UV-resistant, sturdy and durable, the patent being specifically incorporated herein by reference.

Other proposals have involved multi-positional chairs. The problem with these chairs is that they do not provide both a lounge chair and a bar stool in the same configuration, with the chairs having different heights. Also, the chairs are not stackable. Even though the above cited chairs meet some of the needs of the market, a multi-positional chair assembly that comprises a frame portion defined by a pair of sinuous shape traversed by a flexible panel, which can be positioned in multiple positions to provide a sitting surface, from either a lounge chair position, and a higher elevated stool position, is still desired.

SUMMARY

Illustrative embodiments of the disclosure are generally directed to a multi-positional chair assembly. The chair assembly comprises a frame portion defined by a pair of sinuously-shaped bars traversed by a flexible panel. The frame portion includes a back support section, a middle section, and a buttocks support section. The sections are joined at multiple junctions defined by a bowed shape. A resilient panel traverses the pair of sinuously-shaped bars, providing a supportive surface for a user. The panel may include a resilient metal sheet, apertures, or parallel strips of material.

The frame portion can be positioned in multiple positions to provide a sitting surface, including a lounge chair position and a higher elevated stool position. The chair assembly reconfigures between the lounge chair position and the stool position through rotation. Rotating the buttocks support section and the legs to engage the ground surface achieves the lounge chair position. And rotating the chair so that the back support section and the legs engage the ground surface achieves the stool position.

In one aspect, the chair assembly comprises:

a frame portion define by a pair of sinuously-shaped bars, the frame portion having a back support section, a middle section, and a buttocks support section, the sections joined at multiple junctions defined by a bowed shape;

a pair of legs extending from the middle section; and a panel traversing the pair of sinuously-shaped bars, whereby when the buttocks support section and the legs engage a ground surface, the chair assembly is oriented in a lounge chair position, whereby when the back support section and the legs engage the ground surface, the chair assembly is oriented in a stool position.

In another aspect, the bars comprise metal tubes.

In another aspect, the metal tubes comprise an aluminum material.

In another aspect, the sinuously-shaped bars terminate at a first cross bar, and an opposing second cross bar.

In another aspect, the first cross bar comprises at least one first grip.

In another aspect, the second cross bar comprises at least one second grip.

In another aspect, one of the junctions is defined by an angle less than 45 degrees.

In another aspect, one of the junctions is defined by an angle greater than 45 degrees.

In another aspect, the legs terminate at a pair of feet.

In another aspect, the panel comprises a resilient metal sheet.

In another aspect, the panel forms multiple apertures.

In another aspect, the panel comprises multiple spaced-apart resilient strips.

In another aspect, the chair assembly reconfigures between the lounge chair position and the stool position through rotation, whereby rotating the buttocks support section and the legs engaging the ground surface to the back support section and the legs engaging the ground surface.

In another aspect, the buttocks support section in the stool position is at a higher elevation than the middle section in the lounge chair position, whereby a user is more elevated in the stool position than the lounge chair position.

One objective of the present invention is to provide a unique chair assembly that can be manually rotated to achieve a lounge chair position and a stool position.

Another objective is to enable the user to be elevated in the stool position.

Yet another objective is to configure the frame portion, such that multiple chair assemblies are easily stacked.

An exemplary objective is to provide two different seating heights, where a lower height configuration (lounge chair position) can be located in front while higher height configuration (stool position) is located in the back to allow views without obstructed views.

Additional objectives are to conserve space through use of one chair that can be configured into two different positions.

Yet another objective is to provide a chair assembly that can be used both indoors and outdoors.

Additional objectives are to provide an inexpensive to manufacture chair assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A multi-positional chair assembly 100 is referenced in FIGS. 1-29. Multi-positional chair assembly 100, hereafter "chair assembly 100" comprises a frame portion 104 that forms the rigid supportive characteristics of the invention. Frame portion 104 is uniquely shaped in a generally sinusoidal configuration that is ergonomic, enables rotational maneuverability into two different styles of chairs, and facilitates stacking of multiple chair assemblies. The sinusoidal shape of frame portion 104 also creates an ornamental element that favors modern furniture design.

Figure 1:
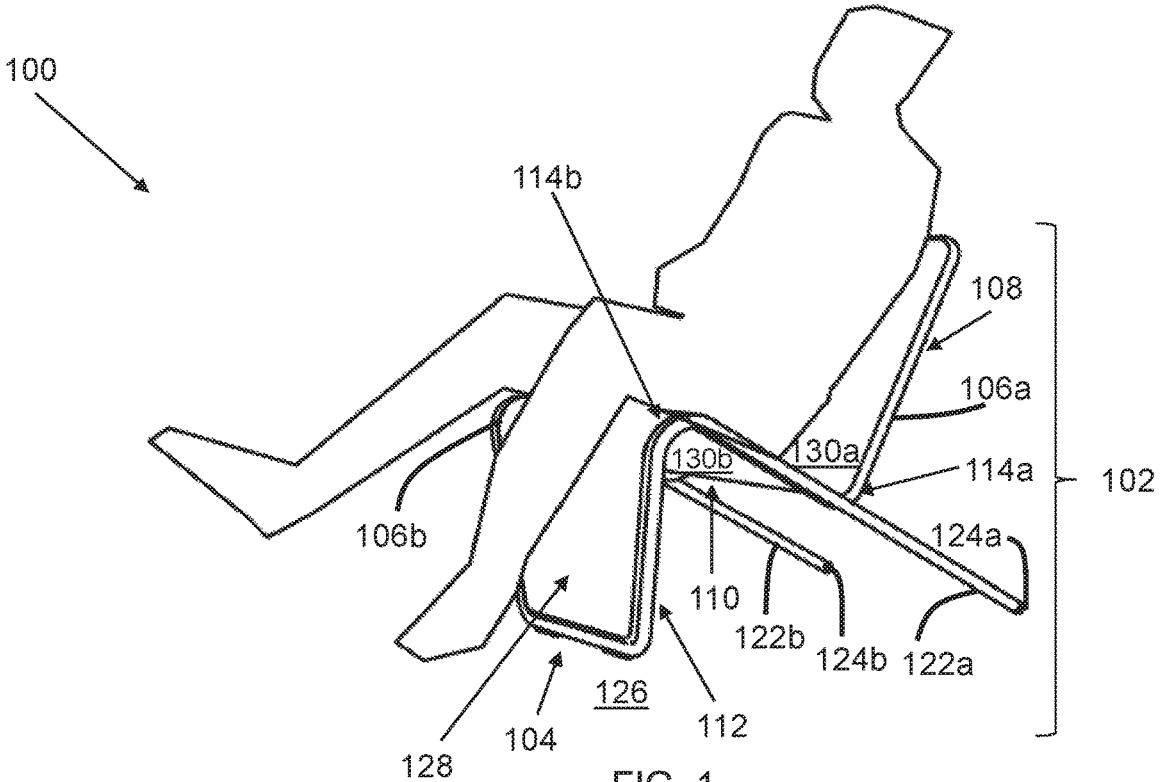
FIG. 1 illustrates a perspective view of a user sitting on an exemplary chair assembly oriented in the lounge chair position, in accordance with an embodiment of the present invention.

As FIG. 1 references, frame portion 104 is defined by a pair of sinuously-shaped bars 106*a-b*. Sinuously-shaped bars 106*a-b* have substantially the same shape and dimensions. Sinuously-shaped bars 106*a-b* run in a parallel, longitudinal orientation. In one non-limiting embodiment, sinuously-shaped bars 106*a-b* are metal tubes fabricated from aluminum, or other lightweight materials, such as plastic, bamboo, and the like. However, in other embodiments, bars 106*a-b* may be hollow rectangles, elongated cylinders, flat rebars, or other material configuration known in the art of chairs.

Figure 2:
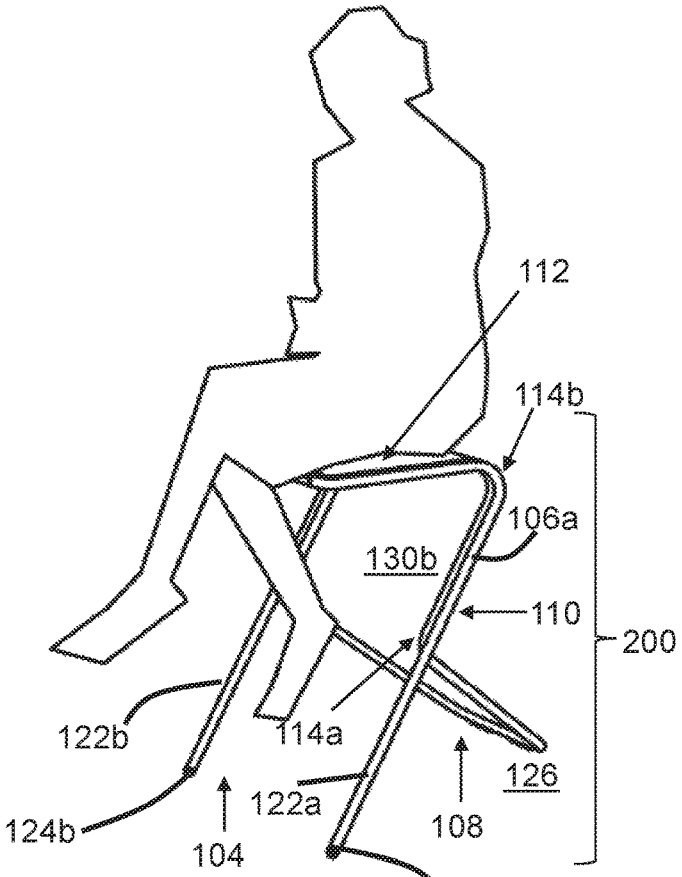
FIG. 2 illustrates a perspective view of a user sitting on the chair assembly oriented in the stool position, in accordance with an embodiment of the present invention.

As FIG. 2 illustrates, frame portion 104 is divided into three sections 108, 110, 112 along the longitudinal. Each section is repositionable to achieve a desired configuration for the chair, i.e., lounge chair position 102, stool position 200. Sections include a back support section 108, a middle section 110, and a buttocks support section 112. The sections 108, 110, 112 are joined at multiple junctions 114*a-b* that, in one embodiment, form in the sinuously-shaped bars 106*a-b*. Junctions 114*a-b* are defined by a bowed shape. As discussed below, the bowed shape at the junctions 114*a-b* can have different angles.

Figure 3:
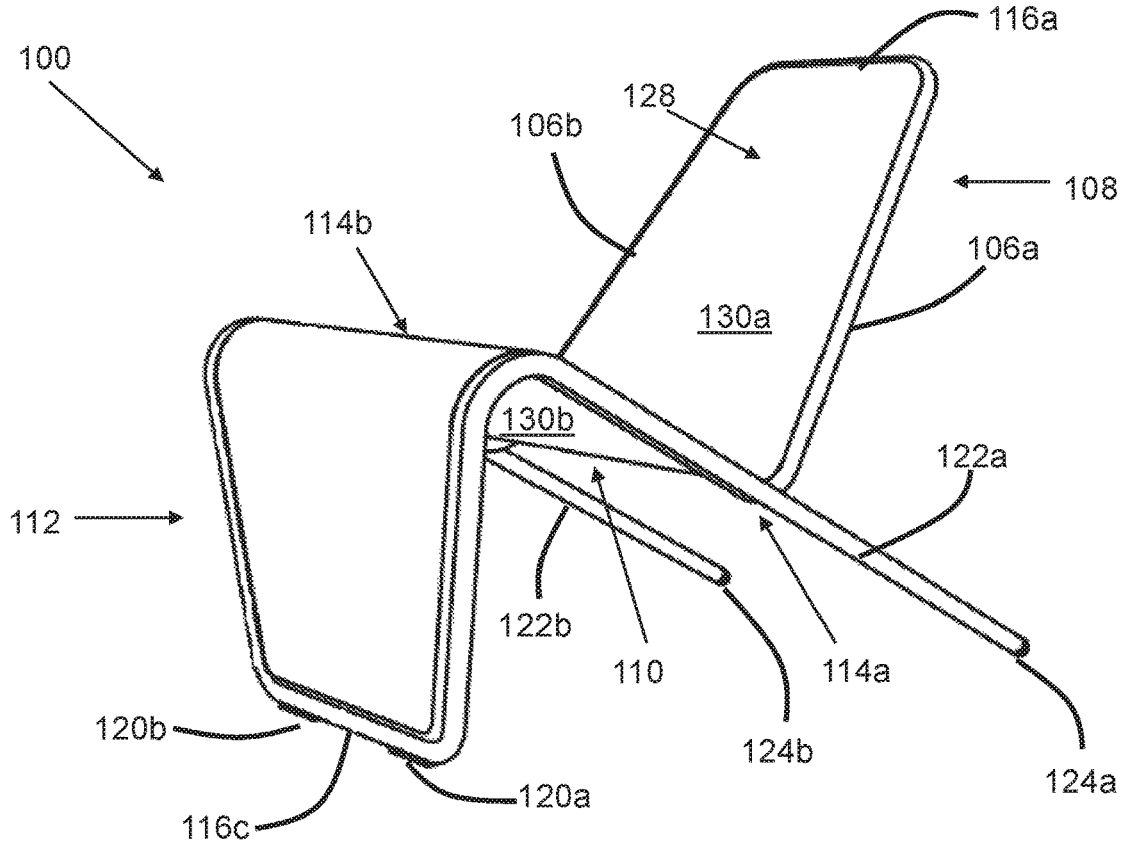
FIG. 3 illustrates a front perspective view of the chair assembly oriented in the lounge chair position, showing the sections and the panel, in accordance with an embodiment of the present invention.

In some embodiments, one of the junctions 114*a* is defined by an angle greater than 45°, and the other junction 114*b* is defined by an angle less than 45°. As FIG. 3 illustrates, back support section 108 shares an obtuse angle with middle section 110, creating a flatter reclining area. This can create a supportive structure for the back of the user in the lounge chair position 102. And the buttocks support section 112 shares an acute angle with middle section 110. This acute angle can create a supportive structure on the ground surface 126 while in the stool position 200.

Figure 4:
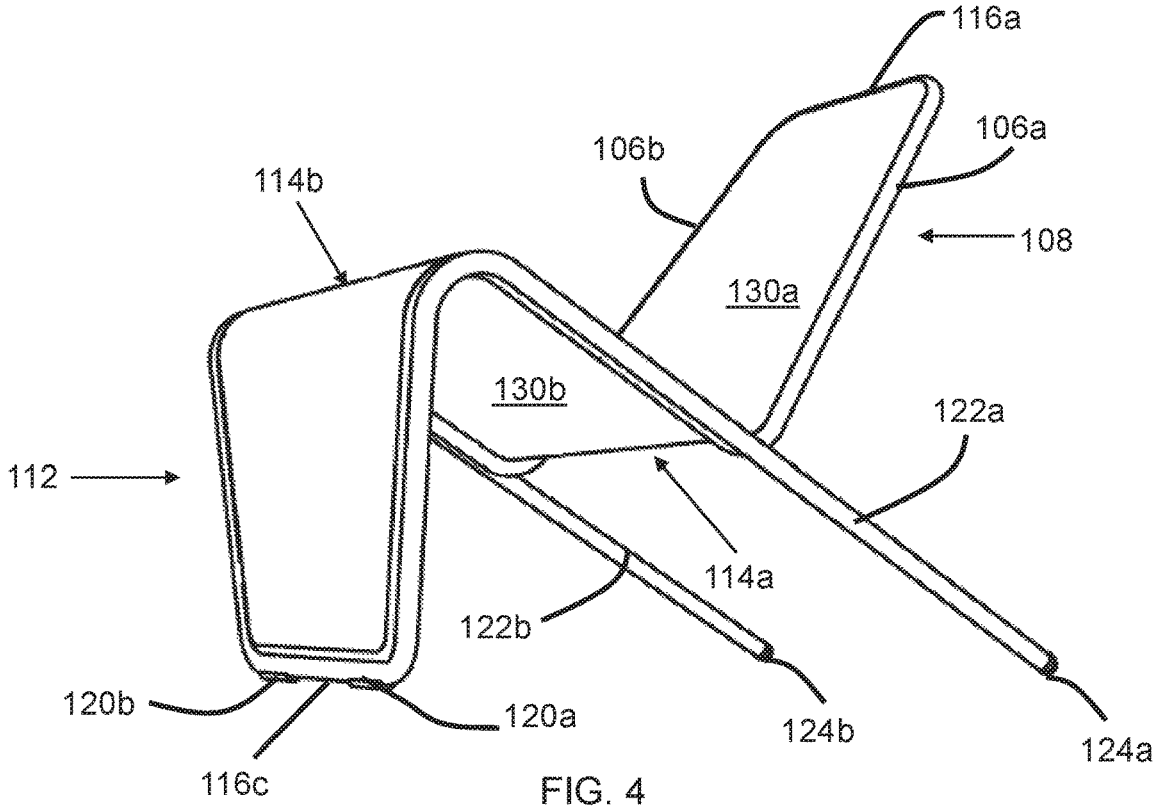
FIG. 4 illustrates a side perspective view of the chair assembly oriented in the lounge chair position, showing the sections and the panel, in accordance with an embodiment of the present invention.
Figure 11:
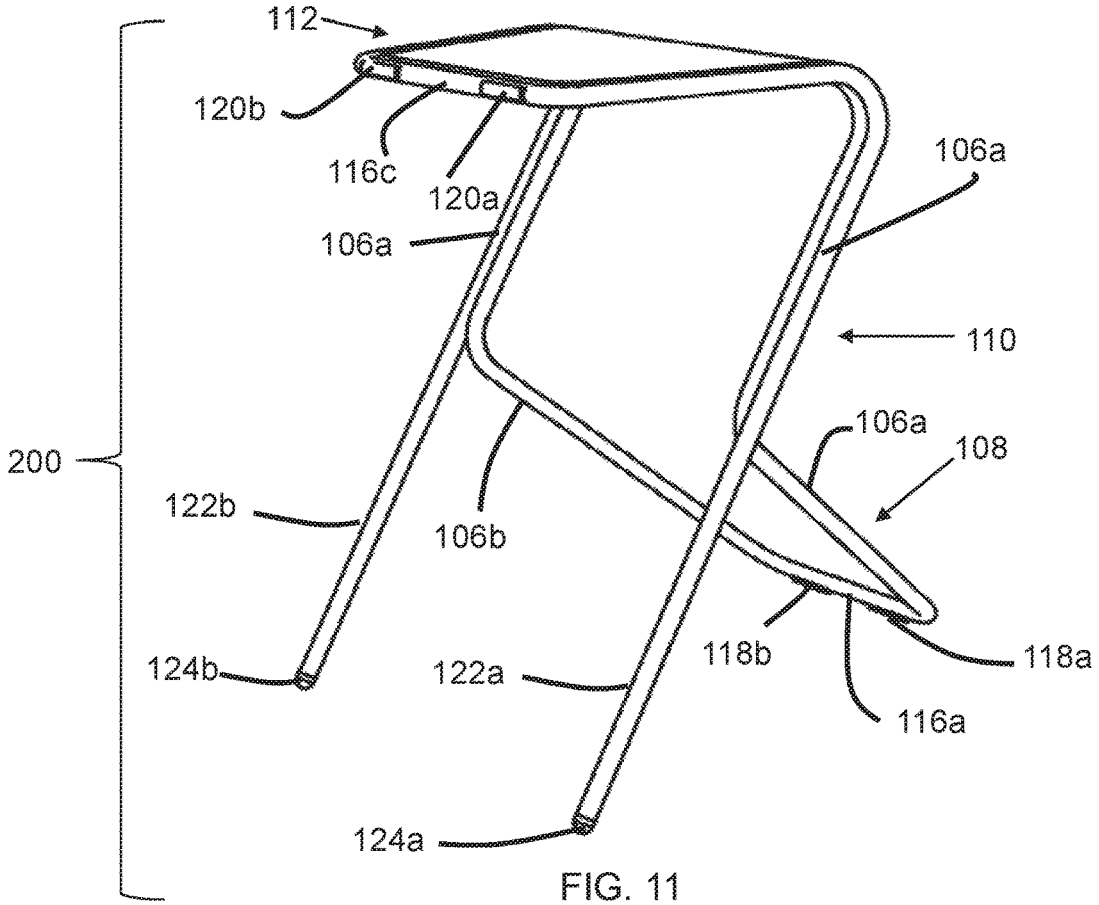
FIG. 11 illustrates a front perspective view of the chair assembly oriented in the stool position, showing the sections and the panel, in accordance with an embodiment of the present invention.

In one embodiment, shown in FIG. 4, a pair of legs 122*a-b* extend from middle section 110 of frame portion 104. Legs 122*a-b* are spaced-apart in a parallel relationship. Legs 122*a-b* engage the ground surface 126 with back support section 108 to achieve stool position 200 (FIG. 11). Legs 122*a-b* also engage the ground surface 126 with buttocks support section 112 to achieve the lounge chair position 102.

In one non-limiting embodiment, legs 122*a*, 122*b* terminate at a pair of feet 124*a*, 124*b* that help prevent slippage. Feet 124*a-b* may include a rubber or plastic component that grips ground surface 126 and protects the floor surface. This can be useful since legs 122*a-b* engage ground surface 126 at an angle, and full weight of user may rest substantially on legs 122*a-b*, as shown in FIGS. 1 and 2.

Figure 5:
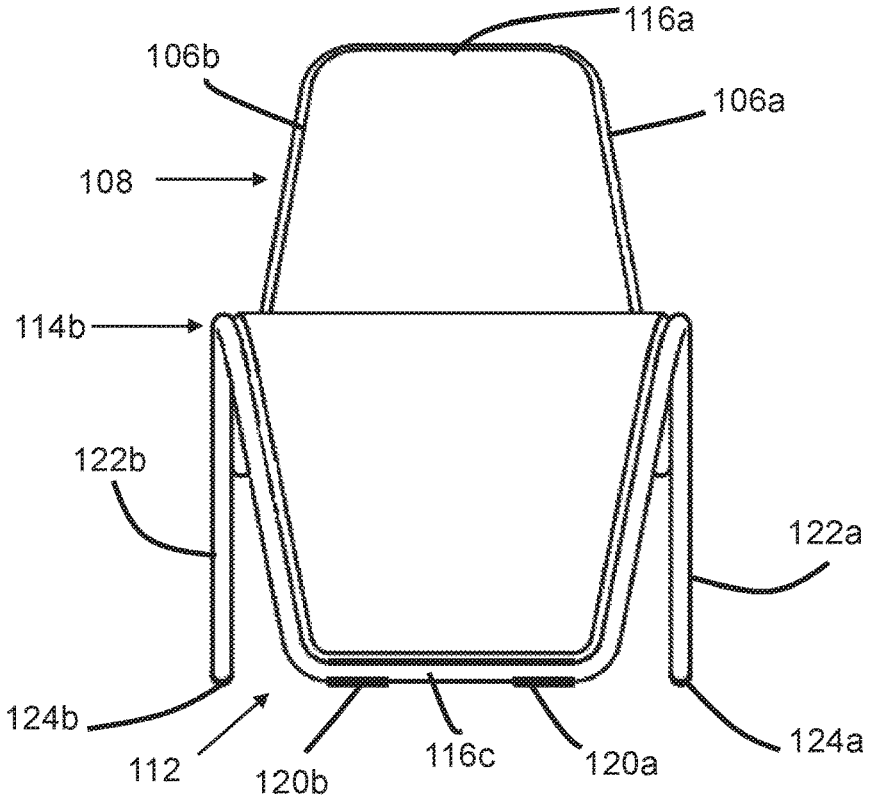
FIG. 5 illustrates a frontal view of the chair assembly oriented in the lounge chair position, showing the sections and the panel, in accordance with an embodiment of the present invention.

Turning now to FIG. 5, sinuously-shaped bars 106*a-c* terminate at a first cross bar 116*a*, and an opposing second cross bar 116*b*. The cross bars 116*a-b* provide lateral structural integrity for frame portion 104. Both first and second cross bars 116*a-b* may be welded to the ends of the back support and buttocks support sections 108, 112, respectively. This may include two plastic or rubber members that fixedly fasten across second cross bar.

In one embodiment, first cross bar 116*a* traverses back support section 108 of the frame portion 104. In some embodiments, first cross bar 116*a* comprises at least one first grip 118*a-b*. First grip 118*a*, 118*b* may include two plastic or rubber members that fixedly fasten across first cross bar 116*a*. First grip 118*a*, 118*b* helps prevent slippage of back support section 108 across ground surface 126 when resting on the ground surface 126, i.e., stool position 200.

Figure 6:
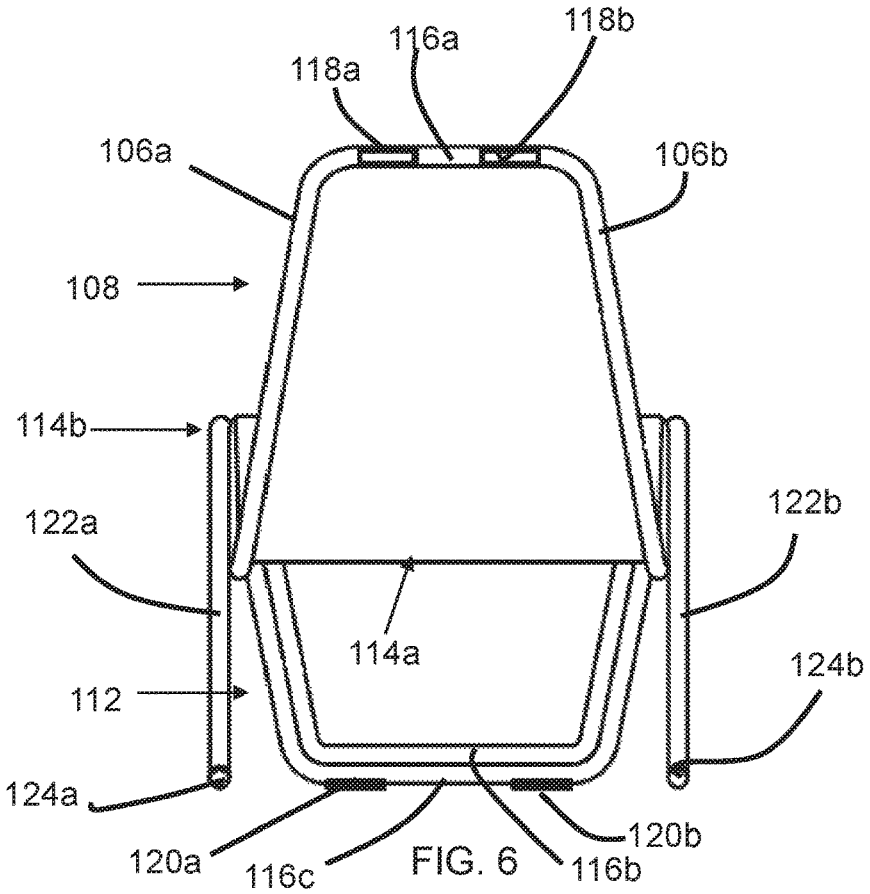
FIG. 6 illustrates a rear view of the chair assembly oriented in the lounge chair position, showing the sections and the panel, in accordance with an embodiment of the present invention.
Figure 7:
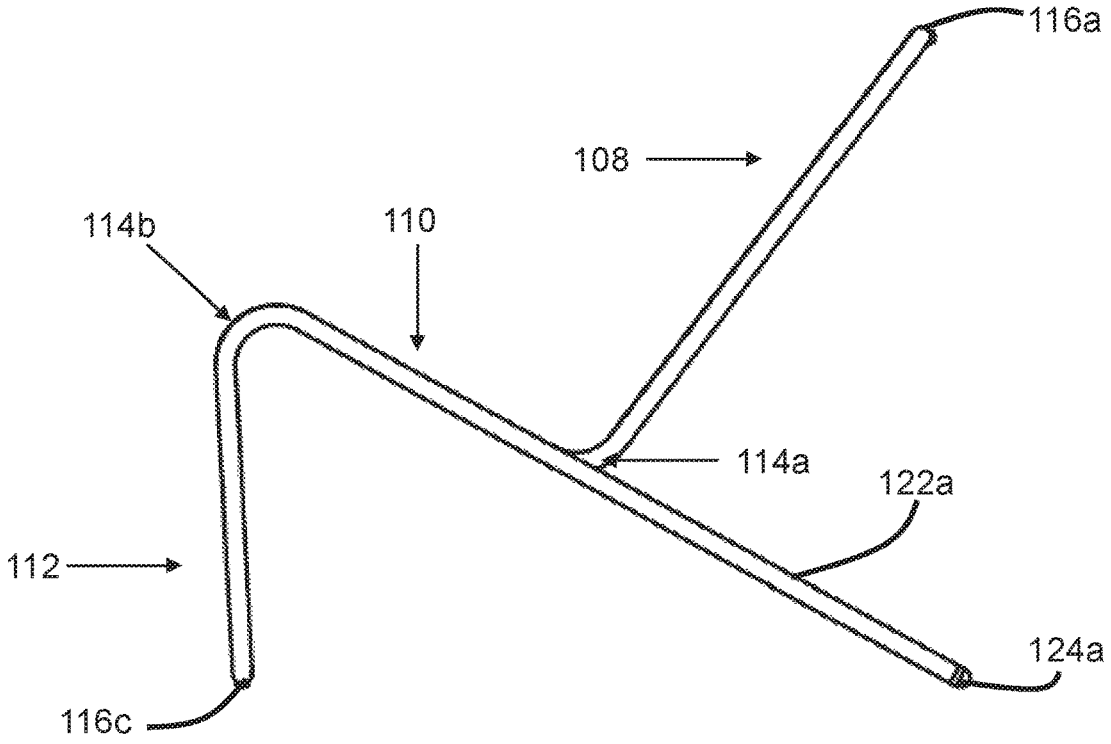
FIG. 7 illustrates an elevated right side view of the chair assembly oriented in the lounge chair position, showing the sections and the panel, in accordance with an embodiment of the present invention.
Figure 8:
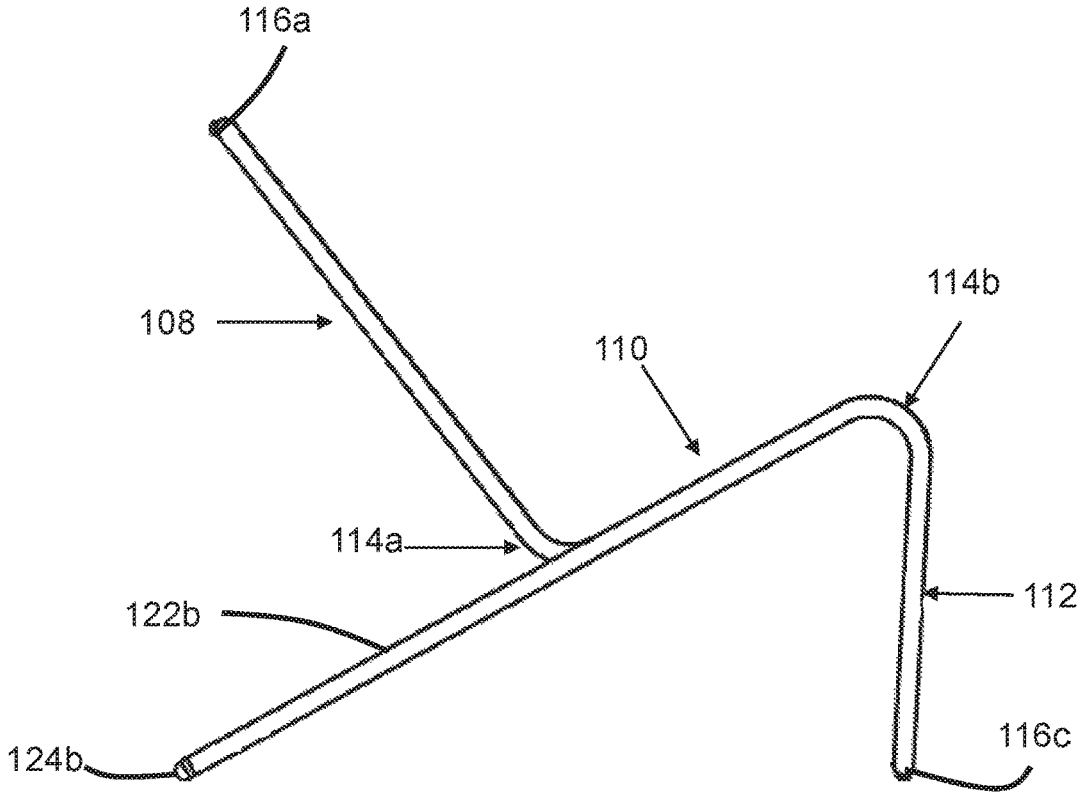
FIG. 8 illustrates an elevated left side view of the chair assembly oriented in the lounge chair position, showing the sections and the panel, in accordance with an embodiment of the present invention.

As illustrated in FIG. 6, cross bar 116*b*, 116*c* traverses the buttocks support section 112. In some embodiments, cross bar 116*c* comprises at least one second grip 120*a-b*. Second grip 120*a*, 120*b* helps prevent slippage of buttocks support section 112 across ground surface 126 when resting on ground surface 126, i.e., lounge chair position 102. Second grip 120*a*, 120*b* may include a rubber or plastic component that fixedly attaches to cross bar 116*c*.

Figure 12:
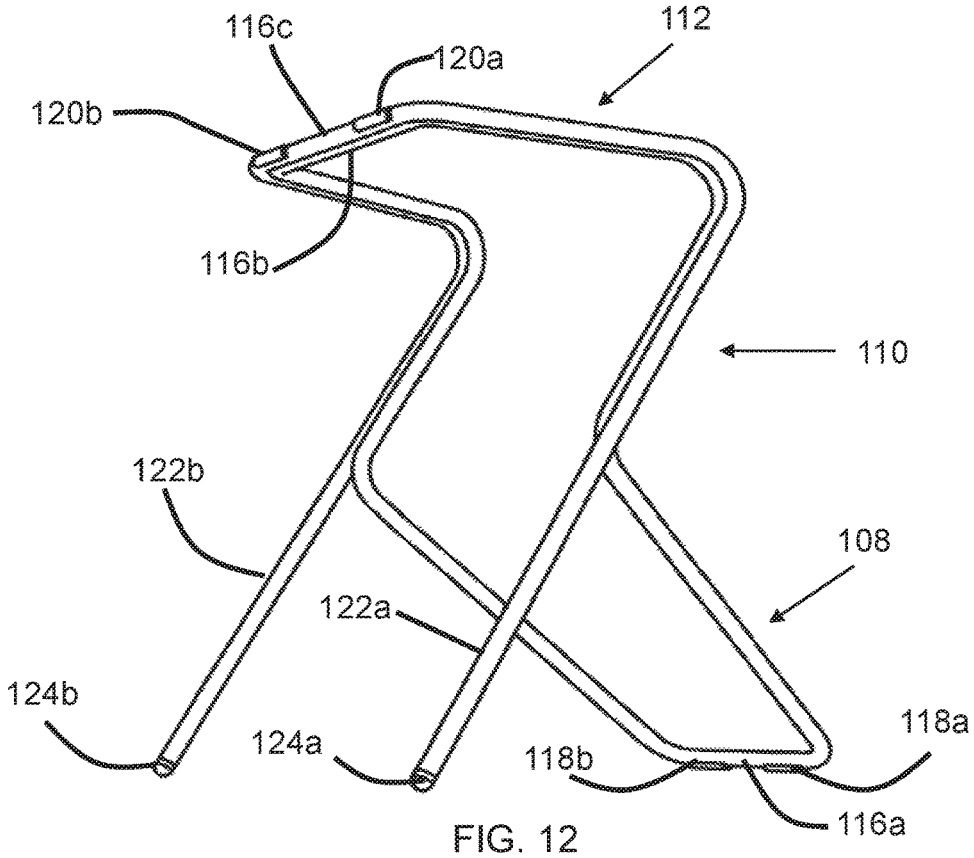
FIG. 12 illustrates a side perspective view of the chair assembly oriented in the stool position, showing the sections and the panel, in accordance with an embodiment of the present invention.
Figure 13:
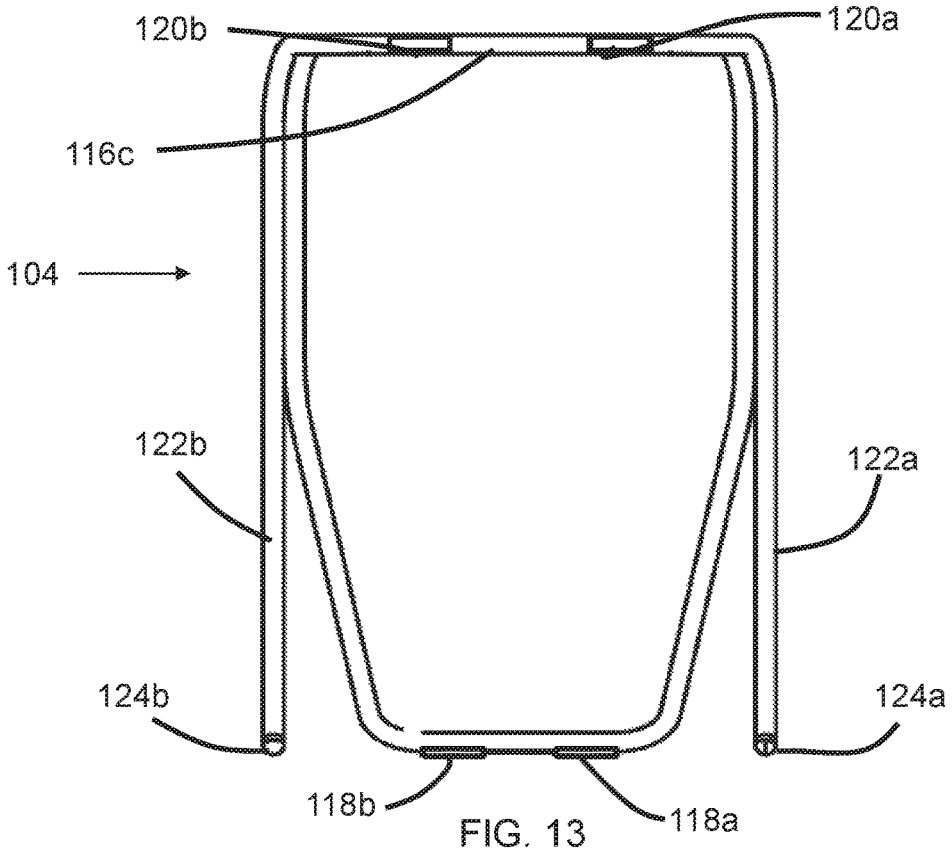
FIG. 13 illustrates front view of the chair assembly oriented in the stool position, showing the sections and the panel, in accordance with an embodiment of the present invention.
Figure 14:
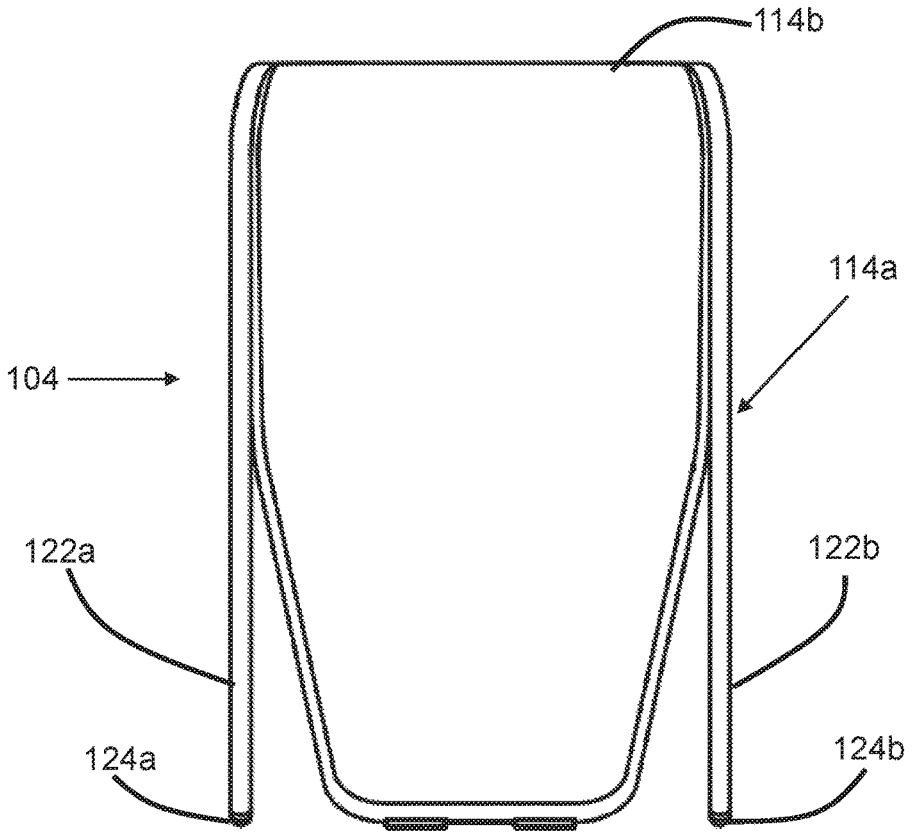
FIG. 14 illustrates a rear view of the chair assembly oriented in the stool position, showing the sections and the panel, in accordance with an embodiment of the present invention.

Chair assembly 100 is unique in that frame portion 104 can be positioned in multiple orientations to provide a sitting surface, including a lounge chair position 102 and a higher elevated stool position 200. Frame portion 104 oriented in lounge chair position 102 is shown in FIGS. 3-10. Stool position 200 configuration of frame portion 104 is illustrated in FIGS. 11 and 12. As shown, both positions are ergonomically dimensioned with ideal heights, widths, and angles that not only offer comfort, but enhance portability and stackability. An additional front and rear view of stool position 200 is shown in FIGS. 13 and 14. In this illustration, the grips 118*a-b*, 124*a-b* are shown to rest on the ground surface for preventing slippage, and protecting the ground surface from damage.

Figure 19:
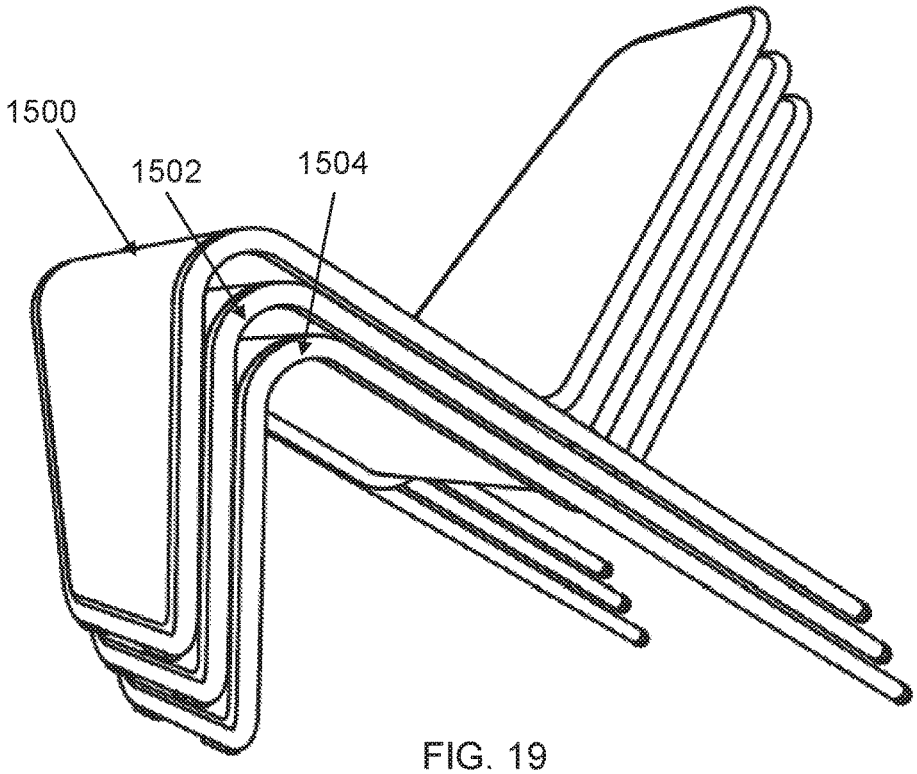
FIG. 19 illustrates a front perspective view of the frame portion for multiple chair assemblies stacked in the lounge chair position, with the middle sections in alignment, the back support sections in alignment, and the buttocks support sections in alignment, in accordance with an embodiment of the present invention.
Figure 20:
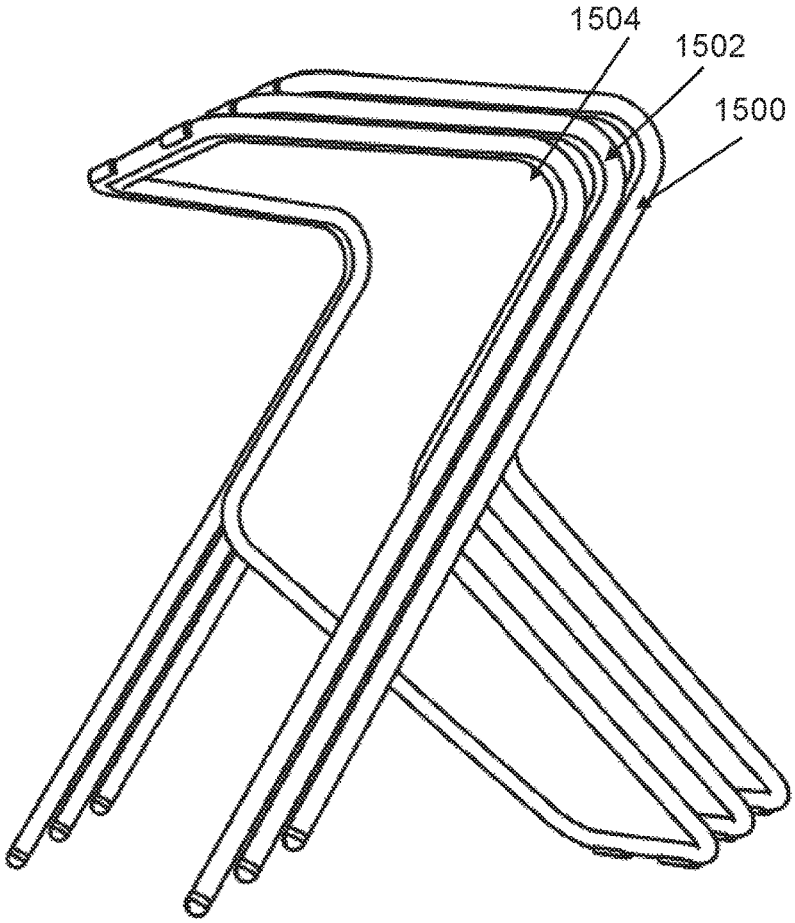
FIG. 20 illustrates a side perspective view of the frame portion for multiple chair assemblies stacked in the stool position, with the middle sections in alignment, showing the buttocks support sections in alignment, in accordance with an embodiment of the present invention.

For example, FIGS. 19 and 20 shows a stacked arrangement of chair assemblies 1500, 1502, 1504. As illustrated, frame portions for multiple chair assemblies 1500-1504 are stacked, with the middle sections in alignment, the back support sections in alignment, and the buttocks support sections in alignment, and parallel with each other. Any number of chair assemblies can be stacked in this manner. The lightweight configuration, and stackable configurations facilitate portability and storage of chair assemblies 1500-1504.

Figure 9:
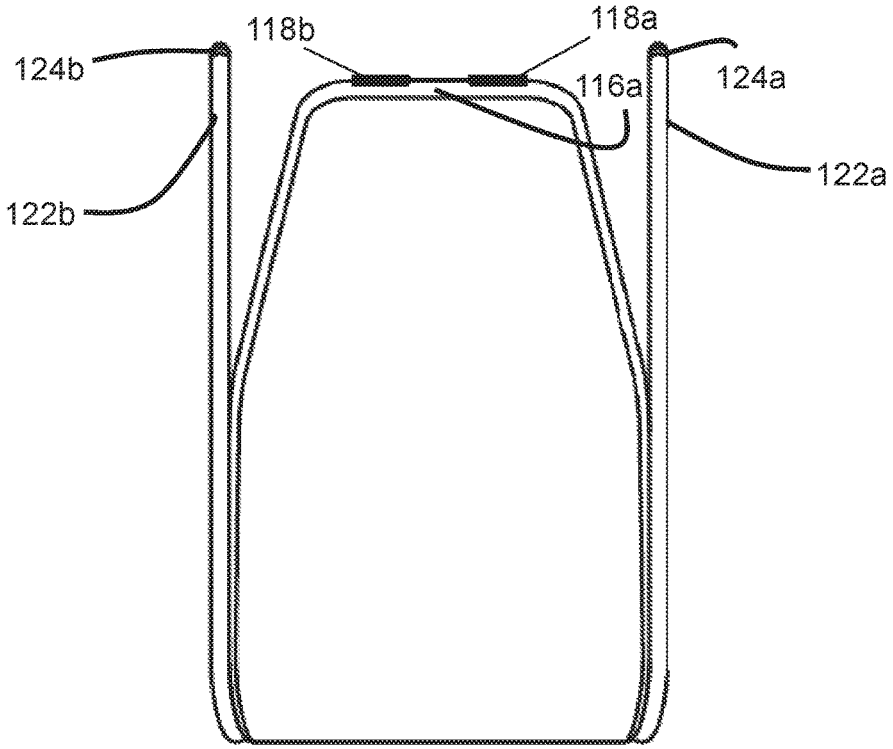
FIG. 9 illustrates top view of the chair assembly oriented in the lounge chair position, showing the sections and the panel, in accordance with an embodiment of the present invention.
Figure 10:
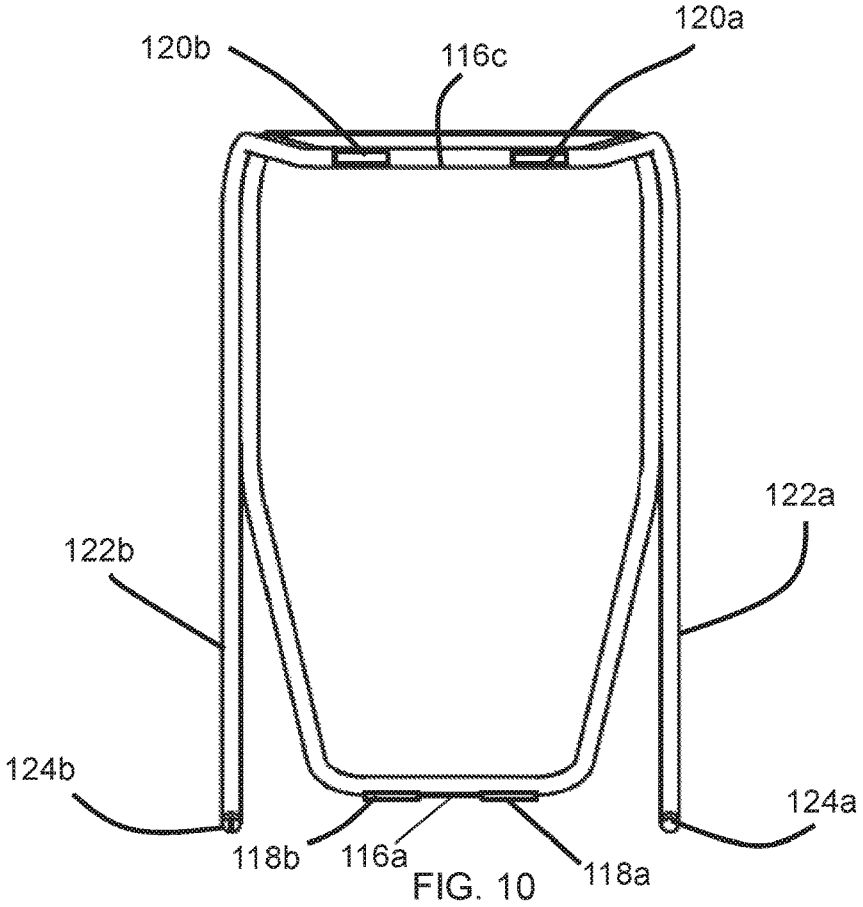
FIG. 10 illustrates a bottom view of the chair assembly oriented in the lounge chair position, showing the sections and the panel, in accordance with an embodiment of the present invention.

A unique aspect of the present invention is that chair assembly 100 reconfigures between the lounge chair position 102 and the stool position 200 through a rotation of frame portion 104. For example, a user can pick up frame portion 104 and rotate, so that the buttocks support section 112 and the legs 122*a-b* engage the ground surface 126 (See FIGS. 7 and 8). This works to achieve the lounge chair position 102. FIG. 9 illustrates top view of the chair assembly oriented in the lounge chair position, showing the sections and the panel.

Figure 15:
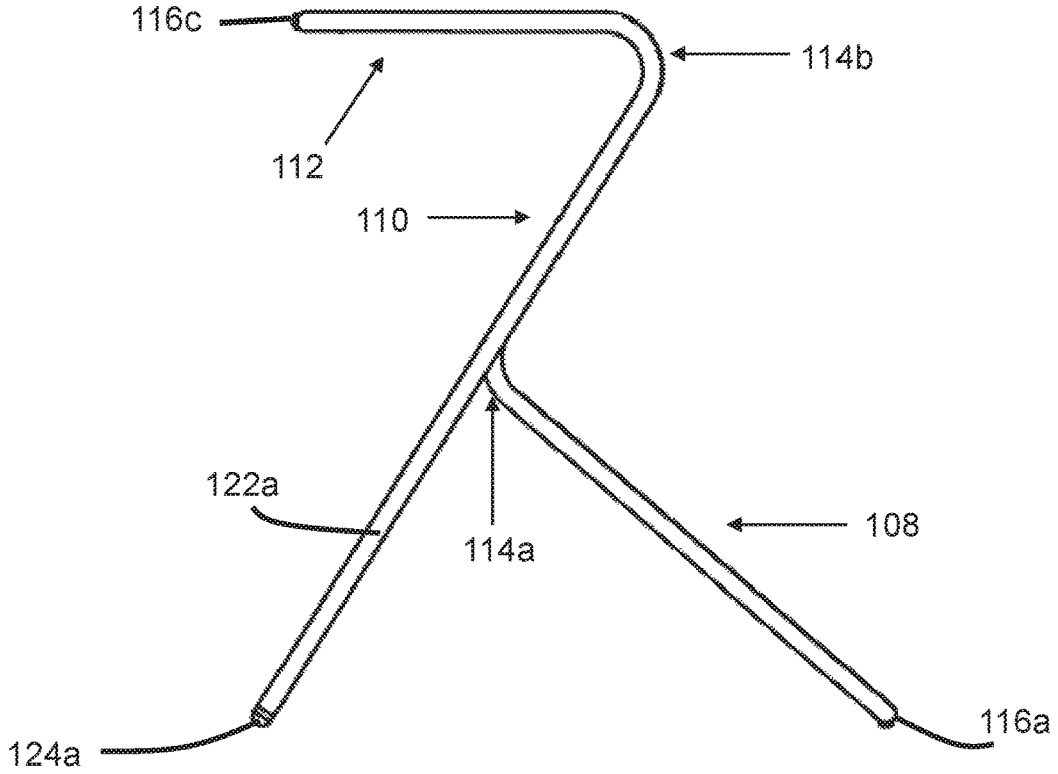
FIG. 15 illustrates an elevated right side view of the chair assembly oriented in the stool position, showing the sections and the panel, in accordance with an embodiment of the present invention.
Figure 16:
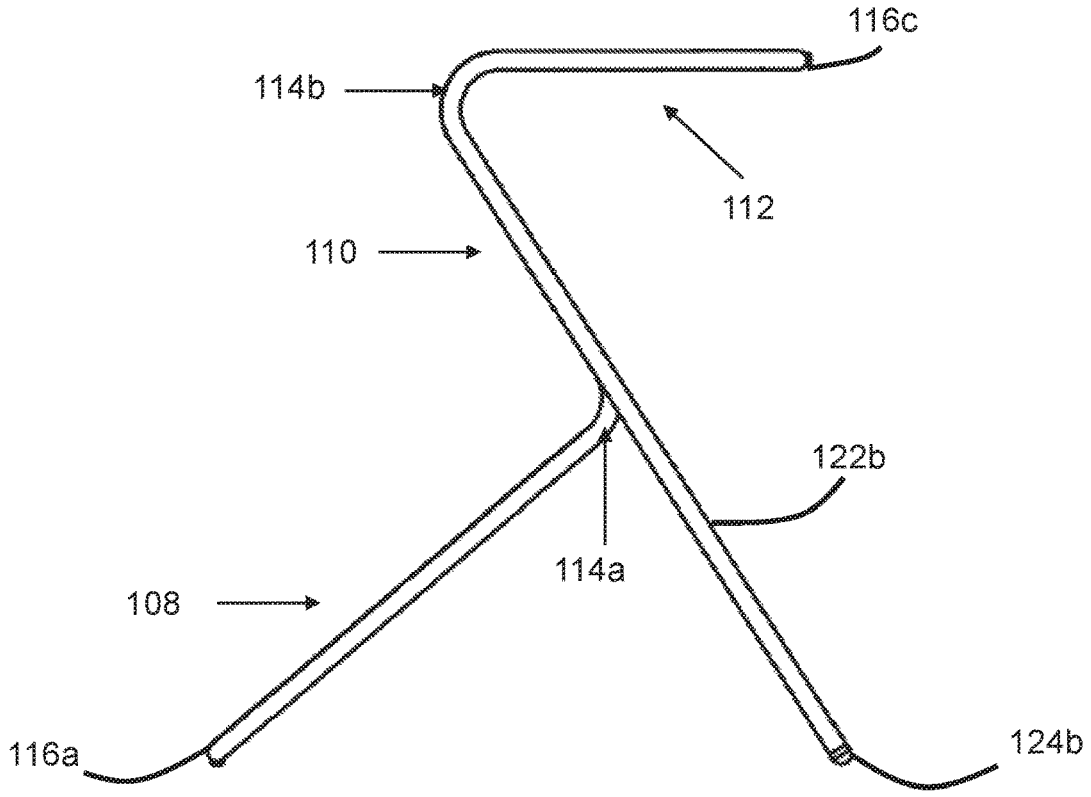
FIG. 16 illustrates an elevated left side view of the chair assembly oriented in the stool position, showing the sections and the panel, in accordance with an embodiment of the present invention.
Figure 17:
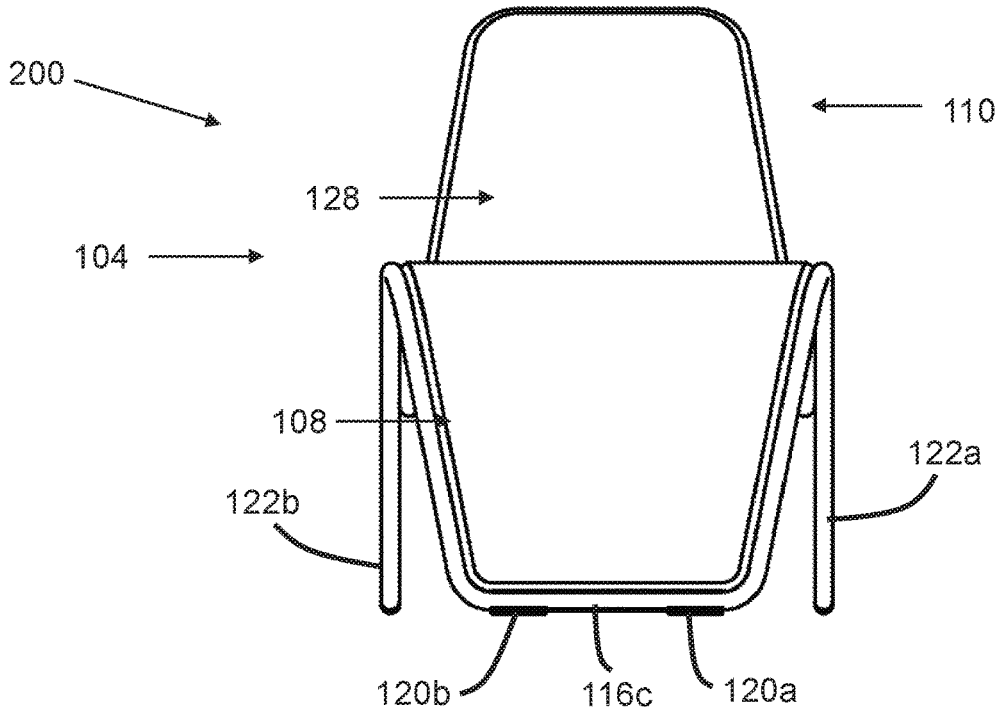
FIG. 17 illustrates a top view of the chair assembly oriented in the stool position, in accordance with an embodiment of the present invention.
Figure 18:
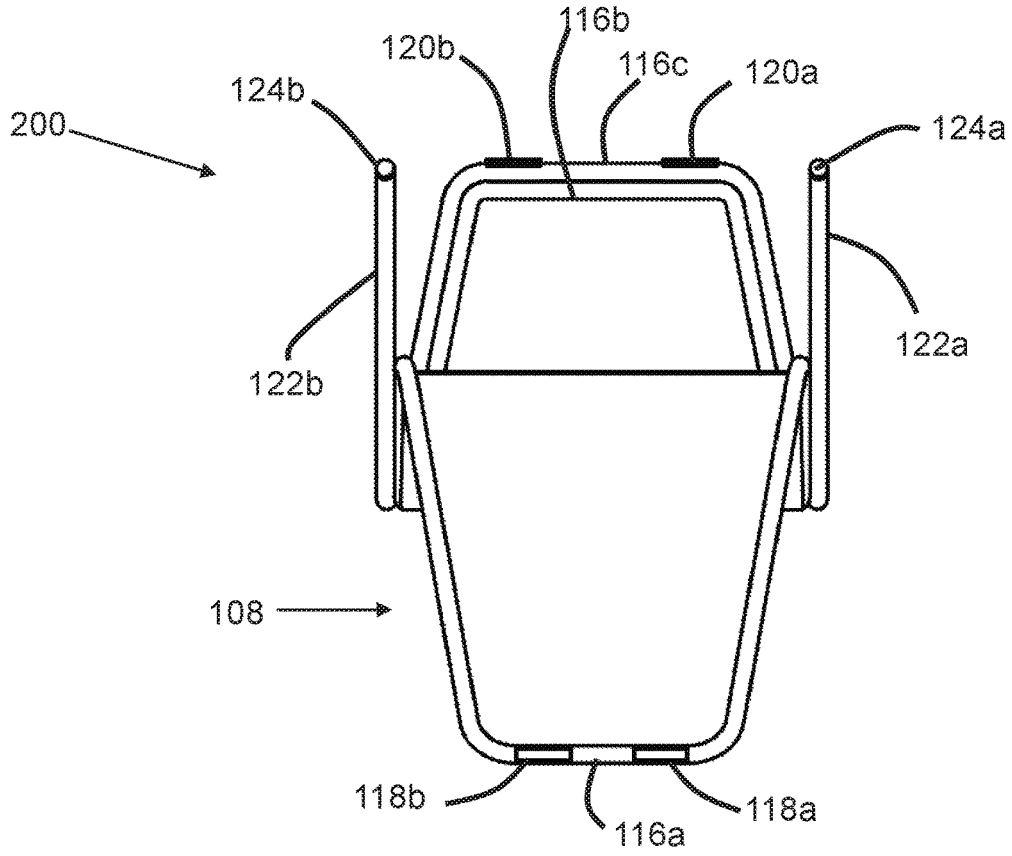
FIG. 18 illustrates a bottom view of the chair assembly oriented in the stool position, in accordance with an embodiment of the present invention.

Conversely, the user may rotate frame portion 104 such that back support section 108 and the legs 122*a-b* rest on the ground surface 126 (See FIGS. 15-16). This achieves the stool position 200. Looking back at FIG. 2, stool position 200 elevates the user above where lounge chair position 102 is. This is because buttocks support section 112 shares an acute angle with middle section 110, creating a greater rise. As FIG. 12 shows, stool position 200 can be a useful bar stool type of chair. Further, stool position 200 is directed to the backs of posture-oriented chairs, being designed to encourage and urge correct seating posture.

And as FIG. 1 illustrates, lounge chair position 102 puts the user in a lower position because back support section 108 shares an obtuse angle with middle section 110, creating a flatter reclining area. It is significant to note that lounge chair position 102 is a more relaxed sitting position for the user, and thus, a lower elevation is desired. This can be useful for serving as a patio chair or for sleeping thereon. As evidenced in the illustrations, the lounge chair position 102 provides healthful seating that encourages low stress posture in the spine with a sloping curvature along the frame portion 104 and panel 128.

Figure 21:
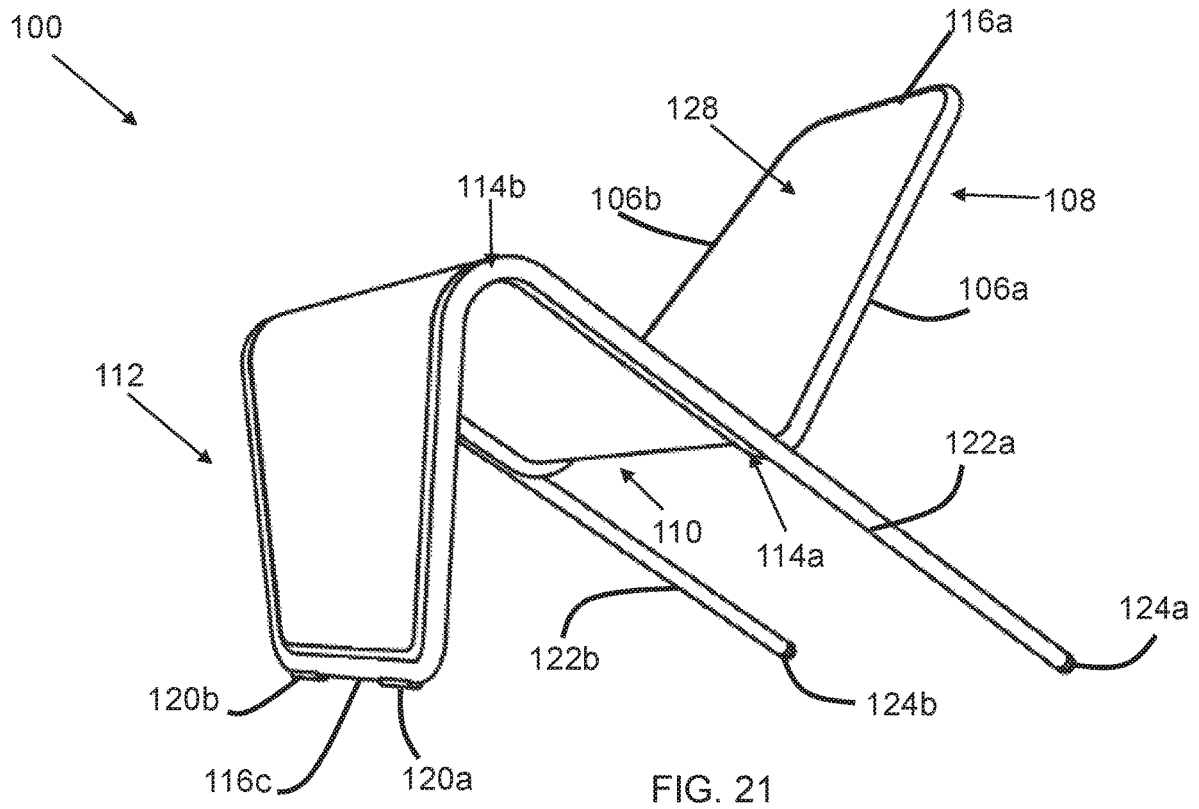
FIG. 21 illustrates a perspective view of the chair assembly, showing a solid panel covering the sinuously-shaped bars, in accordance with an embodiment of the present invention.
Figure 22:
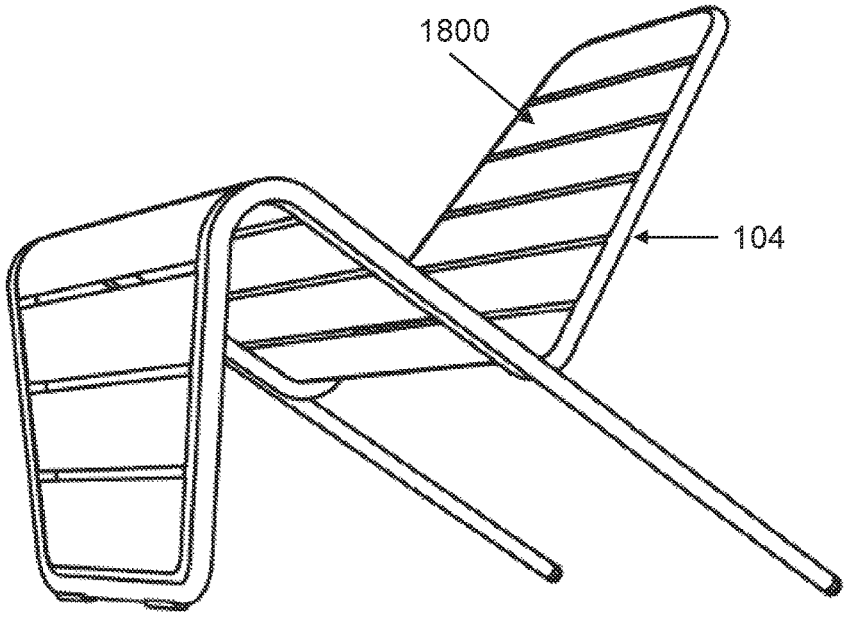
FIG. 22 illustrates a perspective view of the chair assembly, showing the panel as multiple resilient strips traversing the sinuously-shaped bars, in accordance with an embodiment of the present invention.
Figure 23:
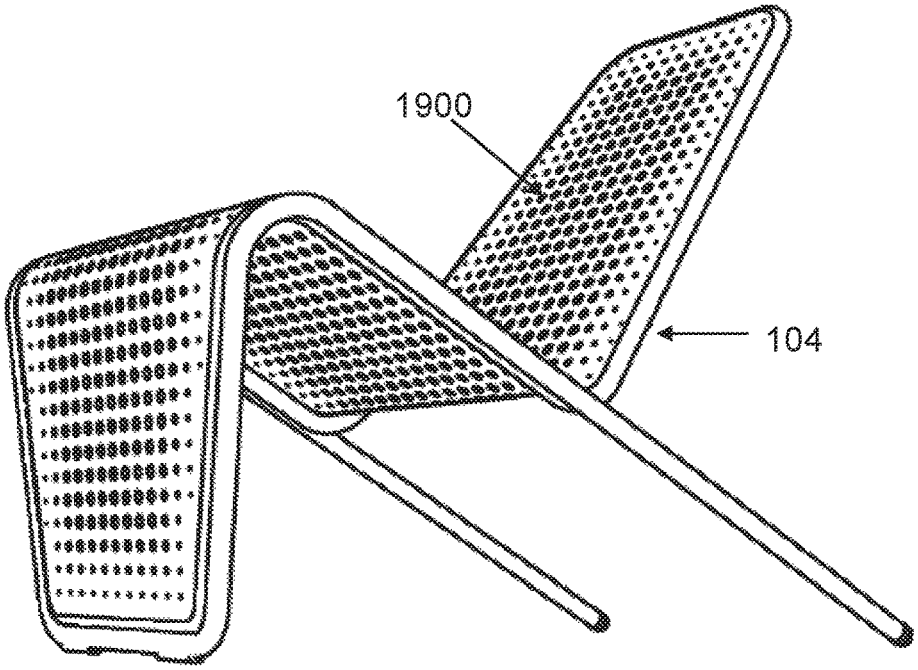
FIG. 23 illustrates a perspective view of the chair assembly, showing the panel as a solid panel defined by multiple apertures traversing the sinuously-shaped bars, in accordance with an embodiment of the present invention.
Figure 24:
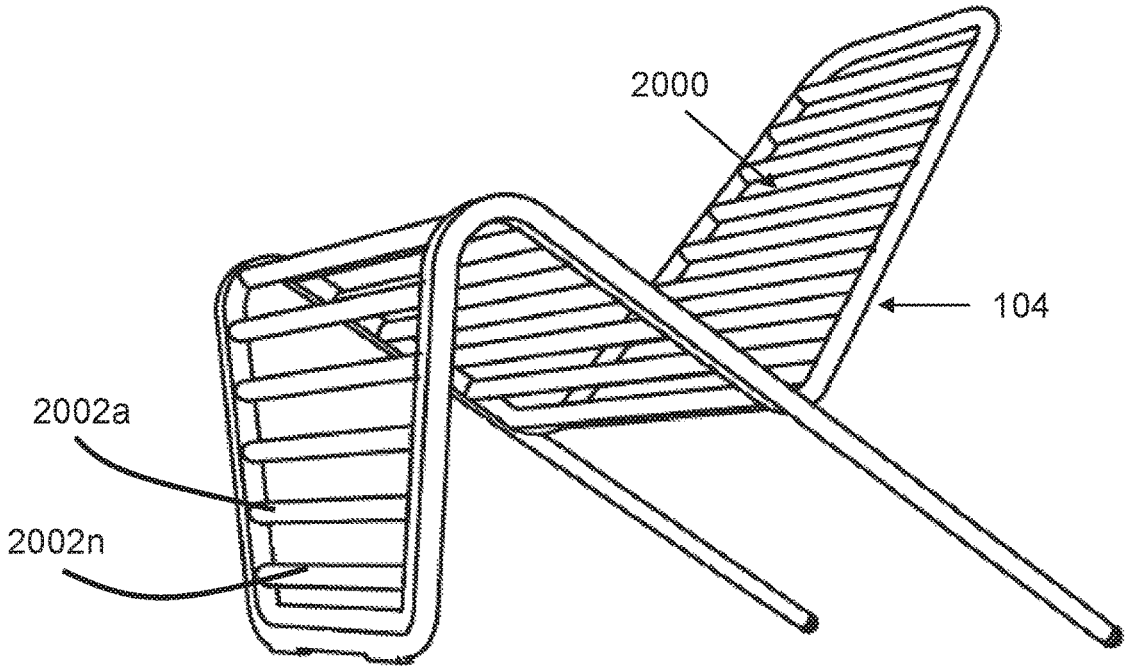
FIG. 24 illustrates a perspective view of the chair assembly, showing the panel as multiple rods or tubes traversing the sinuously-shaped bars, in accordance with an embodiment of the present invention.

In some embodiments, a resilient panel 128 traverses the pair of sinuously-shaped bars 106*a-b*. Panel 128 is configured to provide a supportive surface for a user. FIG. 21 illustrates a perspective view of the chair assembly 100, showing a solid panel 128 covering the sinuously-shaped bars 106*a-b*. Thus, panel 128 is sufficiently rigid to provide backing top the back and buttocks, depending on the position of the frame portion 104.

In some embodiments, panel 128 has an upper side 130*a* that engages the user, and an opposing back side 130*b*. Panel 128 is generally elongated and runs along the length of sinuously-shaped bars 106*a-b*. In one possible configuration, panel 128 is a resilient metal sheet that is solid and comfortably supportive to the back and buttocks of the user. However, other suitable materials for panel 128 may include, without limitation, plastic, nylon, metal, wood, bamboo, fabric, and any composite material.

In an alternative embodiment, a panel 1800 comprises multiple parallel strips of material or fabric. This may include flexible plastic strips that traverse sinuously-shaped bars 106*a-b* (See FIGS. 22 and 24). In yet another alternative embodiment, shown in FIG. 23, a panel 1900 forms multiple apertures that provide a massaging and cooling effect along the body of the panel. In yet another possible embodiment of the present invention, the chair provides a rod-style panel 2000 that is made up of multiple parallel rods/tubes, designed to provide both a massaging effect for the feet, and prevent water from stagnating when used outdoors. In this configuration, multiple bottom rods 2002*a-n* traversing the frame of the buttocks support section 112 when the chair is arranged into the bar stool configuration primarily (See FIGS. 28-29). However, the footrest may also be used as such in the lounge chair configuration. However, when the chair in the bar stool configuration is flipped over, the foot rests are in use.

Figure 25:
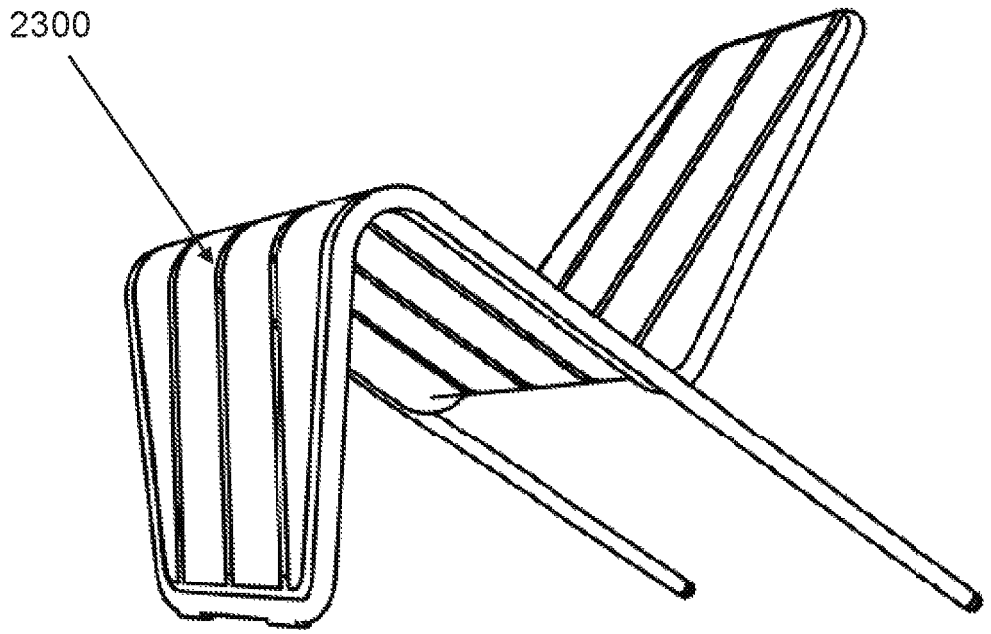
FIG. 25 illustrates a perspective view of the chair assembly, showing an exemplary vertical fin panel longitudinally traversing the framer portion, in accordance with an embodiment of the present invention.
Figure 26:
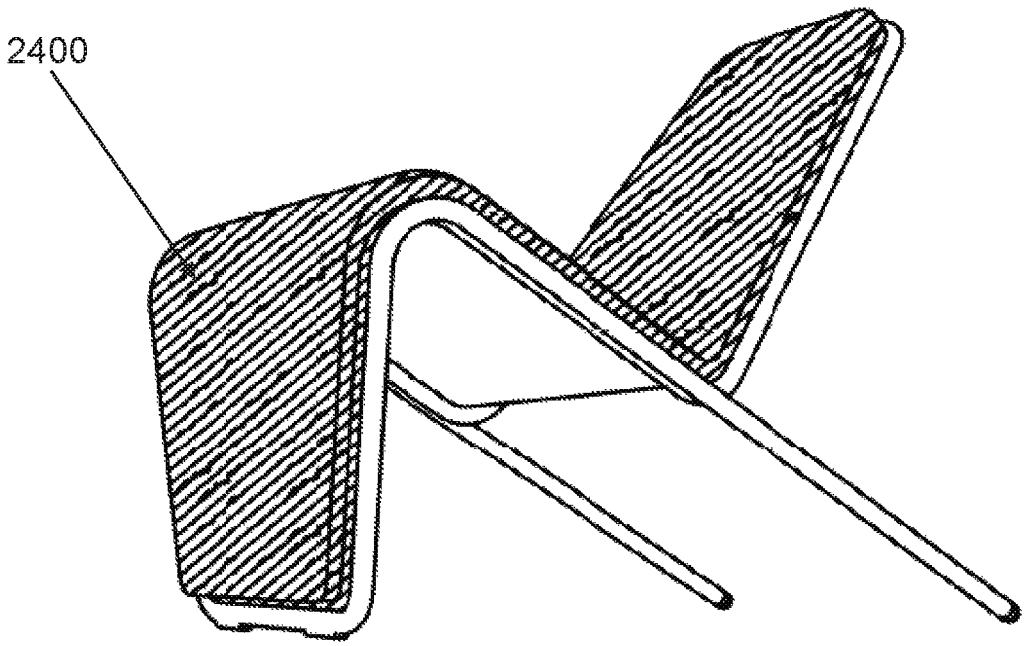
FIG. 26 illustrates a perspective view of the chair assembly, showing an exemplary upholstery panel covering the frame portion, in accordance with an embodiment of the present invention.

Turning now to additional alternative embodiments of chair assembly 100, FIG. 25 references a vertical fin panel 2300 fitted to frame portion 104. Vertical fin panel 2300 comprises multiple longitudinal bars that run longitudinally along frame portion 104. Longitudinal bars may be flexible sheets of plastic or fabric that create a comfortable sitting experience. Additionally, FIG. 26 shows a fabric panel 2400 fitted to frame portion 104. Fabric panel 2400 may include an upholstery, fabric, or gel that integrates into panel.

Figure 27:
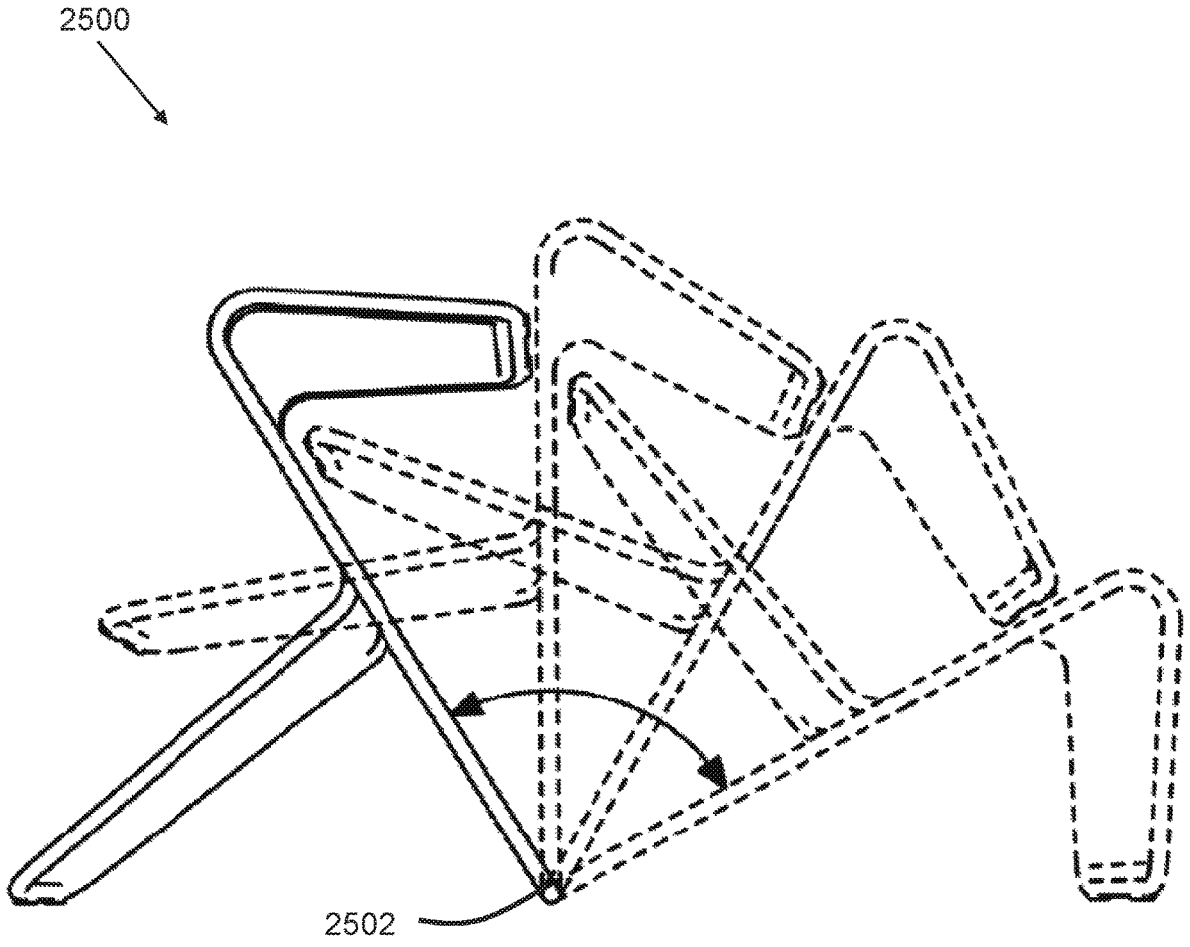
FIG. 27 shows an exemplary chair assembly manually reconfigured between the lounge chair position and the stool position, in accordance with an embodiment of the present invention.

It is significant to note that, despite the panel that is used to cover or traverse frame portion 104, chair assembly 100 rotates between stool position and lounge chair position in substantially the same manner. For example, FIG. 27 shows an exemplary chair assembly 2500 manually reconfigured between the lounge chair position 102 and the stool position 200 through a rotation of frame portion 104. The dashed lines illustrate the motion between positions. As shown the terminus of legs 2502 can serve as a visual reference for rotation between positions 102, 200.

It is significant to note that, when chair assembly 100 is oriented in the stool position 200, the user's feet may have a tendency to hang down—especially for taller users. Thus, another embodiment of the chair provides a unique integrated foot rest at the lower end, i.e., back support section 108 of the stool position 200. This can include multiple rods, tubes, or crossing metal members 2902*a-n* that traverse the frame portion 104, and specifically back support section 108. Rods, tubes, or crossing metal members 2902*a-n* cross frame portion 104 in a closely-spaced, parallel arrangement that provides enough space for the feet to fit in between when being used as a foot rest.

In this arrangement, rods, tubes, or crossing metal members 2902*a-n* provide a supportive foot rest at the lower region of the frame portion 104 from the stool position 200. In this foot rest-enabled configuration, the buttocks support section 112 is the sitting portion in the stool position 200, as discussed above. However, here, the back support section 108 provides the supportive area where the rods, tubes, or crossing metal members 2902*a-n* cross the frame portion 104 to create the foot rests when chair is in the stool position 200.

Figure 28:
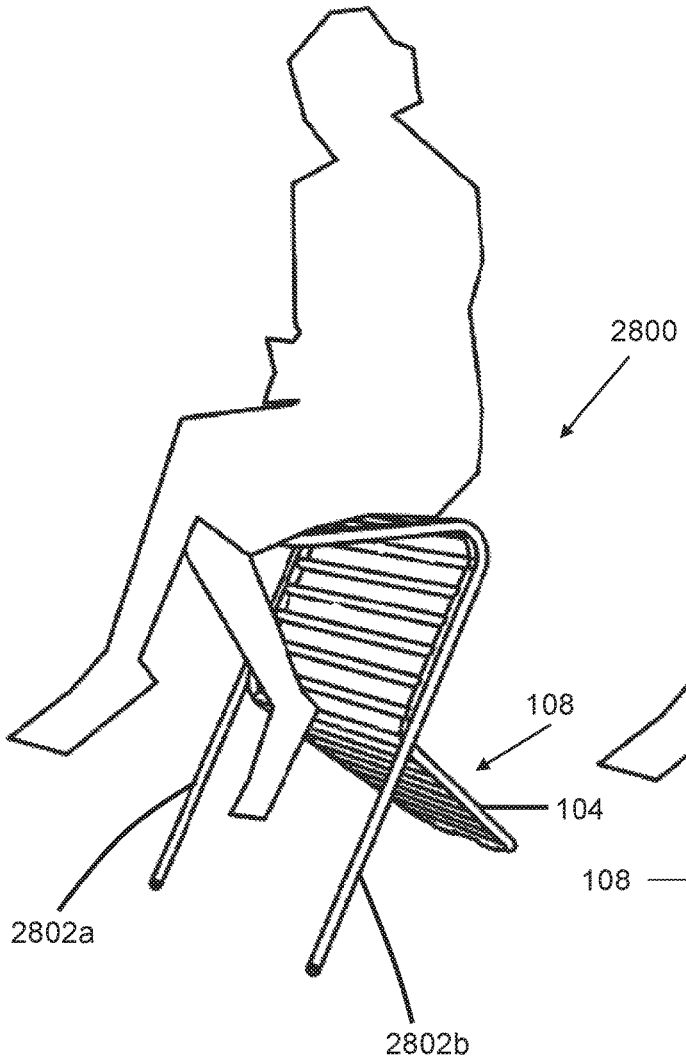
FIG. 28 shows the stool position in a non-flipped position, without a foot rest, in accordance with an embodiment of the present invention.
Figure 29:
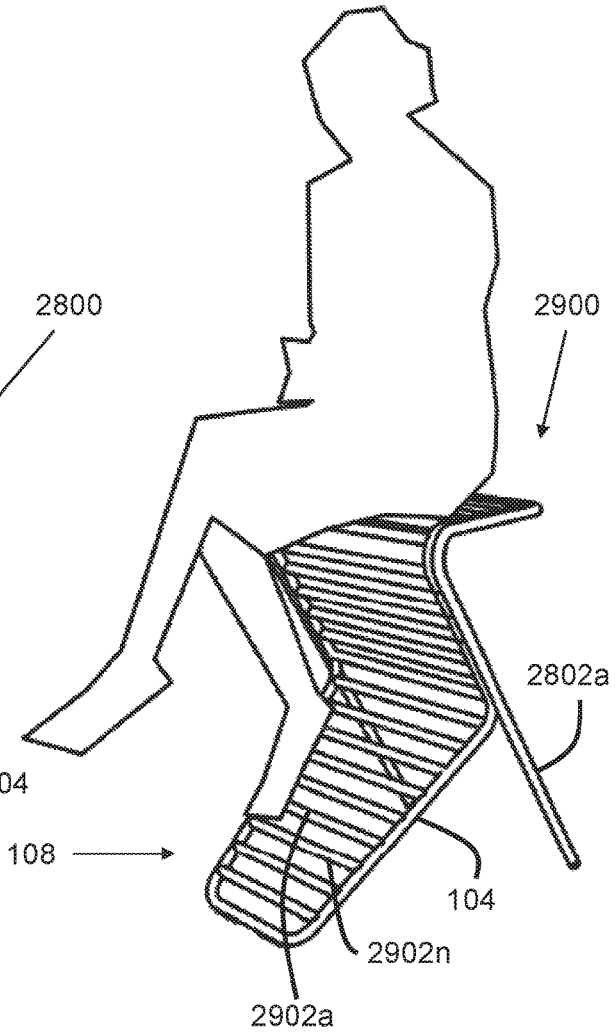
FIG. 29 shows the stool position in a flipped position, with a foot rest forming in the back support section, in accordance with an embodiment of the present invention.

For example, FIG. 28 shows a stool position 2800 in a non-flipped position, without a foot rest. But rather with the two legs 2802*a*, 2802*b* supporting the forward weight of the user. FIG. 29 shows a stool position 2900 in a flipped position (rotated 180°), with a foot rest forming in the back support section. The rods, tubes, or crossing metal members 2902*a-n* form the foot rest in the back support section 108. Thus, the chair in the bar stool configuration provides two options: one with a foot rest, and one without a foot rest by rotating 180°.

In one non-limiting embodiment, rods, tubes, or crossing metal members 2902*a-n* are flexible, lightweight rods that are sturdy enough to support the feet and weight of the user, and also flexible enough to provide a massaging effect to the feet. In yet other embodiments, the rods, tubes, or crossing metal members 2902*a-n* may be cylindrical-shaped, rectangular-shaped, pyramidical-shaped, or irregular-shaped.

Figure 30:
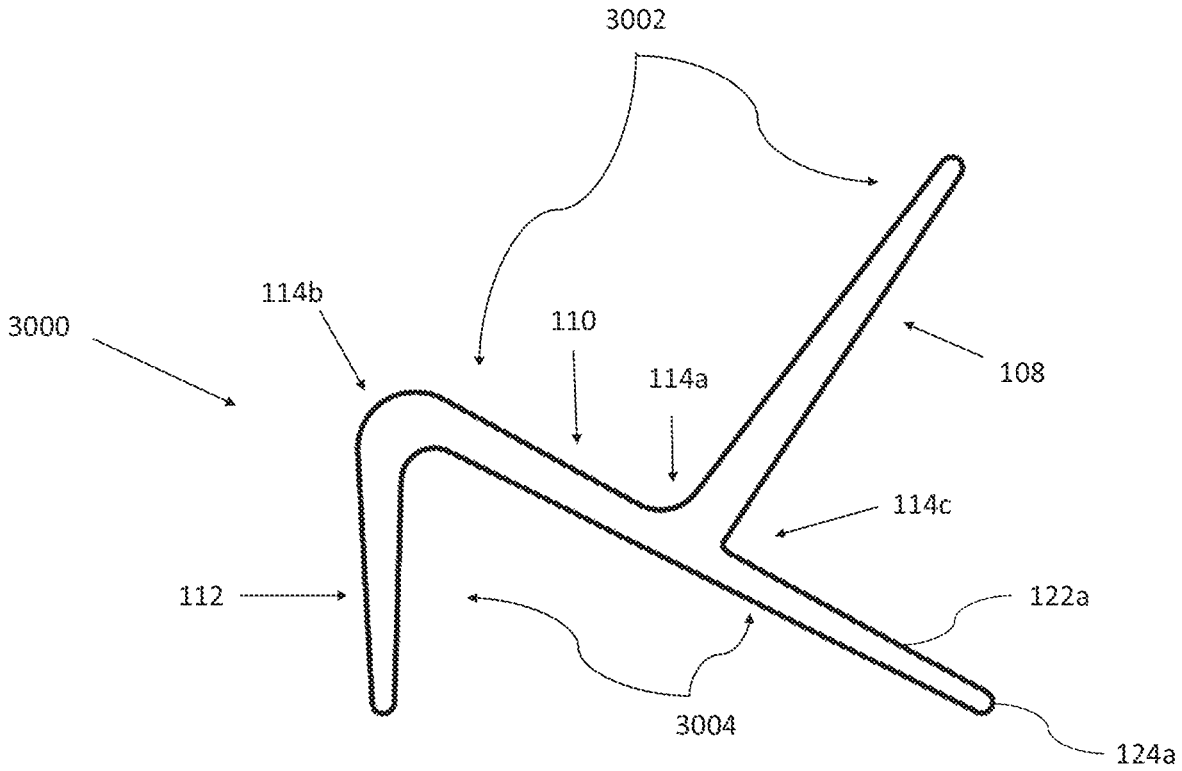
FIG. 30 shows a side view of a molded one-piece chair in accordance with an embodiment of the present invention.
Figure 31:
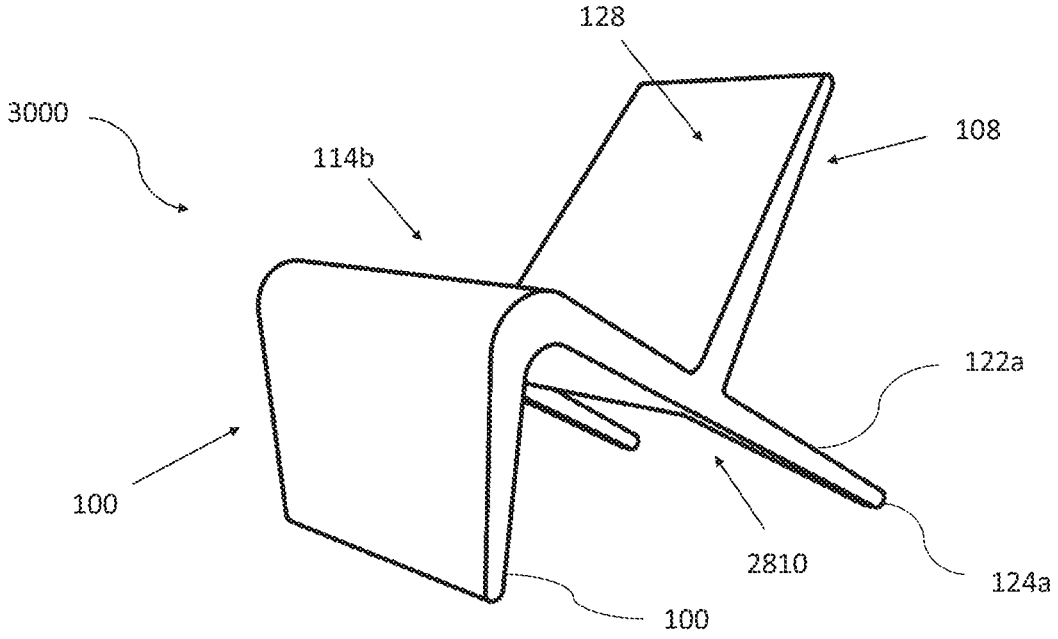
FIG. 31 shows a front perspective view of a molded one-piece chair in accordance with an embodiment of the present invention.

FIGS. 30 and 31 of the present disclosure show a side view and a front perspective view of a molded one piece chair 3000 in accordance with the present disclosure. In some embodiments, molded one piece chair 3000 is comprised of an injection moldable polymer material such as polypropylene, polycarbonate, nylon, or any other suitable injection moldable polymer material. However, any suitable injection moldable material is envisioned and can be used without departing from the spirit or scope of molded one piece chair 3000 disclosed herein. Generally, molded one piece chair 3000 is formed in an injection molding process, although a variety of manufacturing methods are contemplated. Molding techniques may include injection molding, gas assist injection molding and rotational molding. In molded one piece chair 3000, legs 122*a-b* are molded together with other portions of molded one piece chair 3000. In some embodiments of chair assembly 100, legs 122*a-b* may be fitted separately, and here, the chair legs 122*a-b* may be comprised of a polymer material such as those discussed above, a metal material such as steel or aluminum, or any other material suitable for forming the plurality of chair legs 122*a-b*.

As shown in FIGS. 30 and 31, molded one-piece chair 3000 may include S-shaped frame portion 3002 and J-shaped frame portion 3004. In this embodiment, S-shaped frame portion 3002 and J-shaped frame portion 3004 are preferably formed by injection-molding as a single piece. Molded one-piece chair 3000 includes a buttocks support section 112, which may also be referred to herein as a front section of S-shaped frame portion 112. Molded one-piece chair 3000 may also include a middle section 110, which may also be referred to herein as a middle section of S-shaped frame portion 110. Molded one-piece chair 3000 may also include back support section 108, which may also be referred to herein as a back section of S-shaped frame portion 108. Molded one-piece chair 3000 may also include junction 114*b*, which may also be referred to herein as a front bend 114*b*. Molded one-piece chair 3000 may also include a back support section 108, which may also be referred to herein as a back section of S-shaped frame portion 108. Molded one-piece chair 3000 may also include a junction 114*b*, which may also be referred to herein as a front bend 114*b*. Molded one-piece chair 3000 may also include a back bend 114*a*, which may also be referred to herein as a back junction 114*a*.

Legs 122*a-b* comprise leg section of the J-shaped frame portion 2810. In one embodiment, a leg junction 114*c*, which may also be referred to herein as junction 114*c*, is formed between the leg section of the J-shaped frame component 2810 and back section of S-shaped frame portion 130*a*, wherein a vertical plane passing through leg junction 114*c* bisects the front section of S-shaped frame portion 112. wherein in a first orientation of the chair assembly, a terminus of the leg portion of the J-shaped frame portion 2502 is in a generally horizontal plane with a terminus of the back section of S-shaped frame portion 108.

In once embodiment, in the first orientation of the chair according to the present disclosure, the front section of S-shaped frame component 112 is in a generally horizontal plane; and wherein the chair includes at least one panel.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A chair, comprising:

an S-shaped frame portion and a J-shaped frame portion comprising a one-piece injection-molded chair;

wherein the S-shaped frame portion is comprised of an S-shaped frame portion front section, an S-shaped frame portion middle section, and an S-shaped frame portion back section;

wherein the S-shaped frame portion front section, the S-shaped frame portion middle section and the S-shaped frame portion back section are substantially planar;

wherein the S-shaped frame portion front section and the S-shaped frame portion middle section are separated by a front bend;

wherein the S-shaped frame portion middle section and the S-shaped frame portion back section are separated by a back bend;

wherein the generally J-shaped frame portion is comprised of the S-shaped frame portion front section, the front bend of the S-shaped frame portion, the S-shaped frame portion middle section and a J-shaped frame portion leg section;

wherein the J-shaped frame portion leg section is substantially co-planar with the S-shaped frame portion middle section;

wherein in a first orientation of the chair, a terminus of the J-shaped frame portion leg section is in a substantially horizontal plane with a terminus of the S-shaped frame portion back section;

wherein in the first orientation of the chair, the S-shaped frame portion front section is substantially in a horizontal plane; and wherein at least one panel extends through the S-shaped frame portion front section, middle section and back section to provide support for a user.

2. The chair of claim 1, wherein the chair is comprised of an injection moldable polymer material.

3. The chair of claim 1, wherein a leg junction is formed between the J-shaped frame portion leg section and the S-shaped frame portion back section;

wherein a vertical plane passing through the leg junction bisects the S-shaped frame portion front section.

4. The chair of claim 1, wherein the chair is stackable.

5. The chair of claim 1, wherein the S-shaped frame portion and the J-shaped frame portion is comprised of a UV-resistant, weather-proof material.

6. The chair of claim 1, wherein the chair comprises at least one first grip.

7. The chair of claim 1, wherein the chair comprises at least one second grip.

8. The chair of claim 1, wherein the S-shaped frame portion front bend includes an angle less than 90 degrees.

9. The chair of claim 1, wherein the J-shaped frame portion leg section terminates at a pair of feet.

10. The chair of claim 1, wherein the at least one panel forms multiple apertures.

11. The chair of claim 1, wherein the at least one panel comprises multiple spaced-apart resilient strips.

12. The chair of claim 1, wherein the chair reconfigures between a lounge chair position and a stool position through rotation.

13. A chair, comprising:

an S-shaped frame portion and a J-shaped frame portion;

wherein the S-shaped frame portion is comprised of an S-shaped frame portion front section, an S-shaped frame portion middle section, and an S-shaped frame portion back section;

wherein the S-shaped frame portion front section, the S-shaped frame portion middle section and the S-shaped frame portion back section are substantially planar;

wherein the S-shaped frame portion front section and the S-shaped frame portion middle section are separated by a front bend;

wherein the S-shaped frame portion middle section and the S-shaped frame portion back section are separated by a back bend;

wherein the generally J-shaped frame portion is comprised of the S-shaped frame portion front section, the front bend of the S-shaped frame portion, the S-shaped frame portion middle section and a J-shaped frame portion leg section;

wherein the J-shaped frame portion leg section is substantially co-planar with the S-shaped frame portion middle section;

wherein in a first orientation of the chair, a terminus of the J-shaped frame portion leg section is in a substantially horizontal plane with a terminus of the S-shaped frame portion back section;

wherein in the first orientation of the chair, the S-shaped frame portion front section is substantially in a horizontal plane; and wherein at least one panel extends through the S-shaped frame portion front section, middle section and back section to provide support for a user.

14. The chair of claim 13, wherein the chair is one-piece.

15. The chair of claim 13, wherein the chair is comprised of an injection moldable polymer material.

16. The chair of claim 13, wherein a leg junction is formed between the J-shaped frame portion leg section and the S-shaped frame portion back section;

wherein a vertical plane passing through the leg junction bisects the S-shaped frame portion front section.

17. The chair of claim 13, wherein the chair is stackable.

18. The chair of claim 13, wherein the S-shaped frame portion and the J-shaped frame portion is comprised of a metal.

19. The chair of claim 13, wherein the chair comprises at least one grip.

20. A chair assembly, comprising:

an S-shaped frame component and a J-shaped frame component;

wherein the S-shaped frame component is a loop;

wherein the loop is comprised of a first S-shaped side, a second S-shaped side, a linear front bar and a linear back bar; wherein the first S-shaped side and the second S-shaped side are connected by the linear front bar and the linear back bar;

wherein the S-shaped frame component is comprised of an S-shaped frame component front section, an S-shaped frame component middle section, and an S-shaped frame component back section;

wherein the S-shaped frame component front section, the S-shaped frame component middle section and the S-shaped frame component back section of the S-shaped frame component are generally planar;

wherein the S-shaped frame component front section and the S-shaped frame component middle section are separated by an S-shaped frame component front bend;

wherein the S-shaped frame component middle section and the S-shaped frame component back section are separated by an S-shaped frame component back bend;

wherein the J-shaped frame component includes a first J-shaped side, a second J-shaped side and a J-shaped frame component linear front bar;

wherein the J-shaped frame component is comprised of a J-shaped frame component front section, a J-shaped frame component front bend, a J-shaped frame component middle section, and a J-shaped frame component leg section;

wherein the J-shaped frame component leg section comprises a first leg and a second leg;

wherein the S-shaped frame component front section, the S-shaped frame component front bend and the S-shaped frame component middle section are adapted to conform to the J-shaped frame component front section, the J-shaped frame component front bend and the J-shaped frame component middle section;

wherein a portion of the S-shaped frame component is adapted to fit within the J-shaped frame component;

wherein the J-shaped frame component leg section is co-planar with the S-shaped frame component middle section;

wherein in a first orientation of the chair assembly, a terminus of the J-shaped frame component leg section is in a generally horizontal plane with a terminus of the S-shaped frame component back section;

wherein in the first orientation of the chair assembly, the S-shaped frame component front section is in a generally horizontal plane; and wherein the chair assembly includes at least one panel.

* * * * *